US006796155B2

(12) United States Patent
Koyama et al.

(10) Patent No.: US 6,796,155 B2
(45) Date of Patent: Sep. 28, 2004

(54) SHEET THICKNESS DETECTING METHOD AND DEVICE THEREFOR IN BENDING MACHINE, REFERENCE INTER-BLADE DISTANCE DETECTING METHOD AND DEVICE THEREFOR, AND BENDING METHOD AND BENDING DEVICE

(75) Inventors: Junichi Koyama, Kanagawa (JP); Kazunari Imai, Kanagawa (JP); Hitoshi Omata, Kanagawa (JP); Osamu Hayama, Kanagawa (JP); Hidekatsu Ikeda, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 0 days.

(21) Appl. No.: 10/169,742

(22) PCT Filed: Jan. 16, 2001

(86) PCT No.: PCT/JP01/00221

§ 371 (c)(1),
(2), (4) Date: Jul. 17, 2002

(87) PCT Pub. No.: WO01/53018

PCT Pub. Date: Jul. 26, 2001

(65) Prior Publication Data

US 2003/0000268 A1 Jan. 2, 2003

(30) Foreign Application Priority Data

Jan. 17, 2000 (JP) ..... 2000-008304
Jan. 21, 2000 (JP) ..... 2000-012771
Jan. 21, 2000 (JP) ..... 2000-013050
Jan. 27, 2000 (JP) ..... 2000-19248

(51) Int. Cl.[7] ..... B21C 51/00

(52) U.S. Cl. ..... 72/31.11; 72/20.1; 72/20.2; 72/389.3

(58) Field of Search ..... 72/373, 375, 379.2, 72/20.1, 20.2, 21.1, 21.4, 31.1, 31.11, 389.1, 389.3, 702

(56) References Cited

U.S. PATENT DOCUMENTS 4,936,126 A * 6/1990 Sato ..... 72/20.1
5,062,283 A * 11/1991 Miyagawa et al. ..... 72/18.1
5,813,263 A * 9/1998 Tokai ..... 72/21.4
6,161,408 A * 12/2000 Ooenoki et al. ..... 72/31.01
6,266,984 B1 * 7/2001 Gasparini ..... 72/31.11

FOREIGN PATENT DOCUMENTS

| | | | |
|---|---|---|---|
| EP | 0940196 | 9/1999 | |
| JP | 63157722 | 6/1988 | |
| JP | 6-74746 | 3/1994 | |
| JP | 6-49374 | 12/1994 | |
| JP | 5-171339 | * 1/1995 | ..... B21D/5/02 |
| JP | 8-15624 | 2/1996 | |

OTHER PUBLICATIONS

English Language Abstract of JP 6–74746.

English Language Abstract of JP 63–157722.

English Language Abstract of JP 8–15624.

* cited by examiner

*Primary Examiner*—Ed Tolan
(74) *Attorney, Agent, or Firm*—Greenblum & Bernstein, P.L.C.

(57) ABSTRACT

A plate thickness detector for a bending machine causes a punch to make a relative stroke and bend a workpiece mounted on an upper surface of a die cooperatively by the punch and the die. A displacement gauge is provided in the die, is always urged upward from a V-groove of the die, and measures a distance from the upper surface of the die to a lower surface of the workpiece. A ram position detector detects a relative stroke quantity of the punch to the die. The punch is caused to bend the workpiece from a position away from the die by a reference inter-blade distance. A plate thickness arithmetic operation section inputs the relative stroke quantity of the punch at a point at which descent of the workpiece is detected by the displacement gauge or a predetermined point after the point, inputs the displacement quantity of the displacement gauge at this time using ram position detector, and detects the plate thickness of the workpiece by subtracting the detected relative stroke quantity from the reference inter-blade distance and adding the displacement quantity detected by the displacement gauge to the subtraction result.

8 Claims, 23 Drawing Sheets

SHEET THICKNESS DETECTING METHOD AND DEVICE THEREFOR IN BENDING MACHINE, REFERENCE INTER-BLADE DISTANCE DETECTING METHOD AND DEVICE THEREFOR, AND BENDING METHOD AND BENDING DEVICE

TECHNICAL FIELD

The present invention relates to a plate thickness detection method, a plate thickness detector, a reference inter-blade distance detection method, and a reference inter-blade distance detector for a bending machine for bending a workpiece by causing a punch to make a relative stroke and to cooperate with a die in the bending.

In addition, the present invention relates to a bending method and a bending apparatus for directly detecting the relative stroke value of a punch to a die and controlling the relative stroke of the punch by a vertically movable displacement gauge which is provided in the die and protruded from the V groove of the die.

The present invention also relates to a bending method and a bending apparatus capable of conducting accurate bending by calculating a D-value in light of a change in the plate thickness of a workpiece which is generated during the bending.

BACKGROUND ART OF THE INVENTION

According to conventional bending, a nominal plate thickness is input to an NC device and a D-value for a desired bending angle is thereby calculated. An actual plate thickness, however, varies according to the difference in manufacturer or a lot and a desired angle cannot be often obtained.

Considering this, as disclosed in Japanese Patent Application Laid-Open No. 63-157722, the relative pressure of a punch against a die from the torque of a servo motor elevating a ram is measured, and a position corresponding to a rising point of torque is considered as a workpiece upper position so as to detect a plate thickness.

Further, as disclosed in Japanese Patent Application Laid-Open No. 6-74746, a plate thickness is measured by setting a point at which the difference between a linear scale value and an NC device instruction value occurs based on the backlash of a ball screw which drives a ram, as a reference point at which a punch contacts with a workpiece.

However, in the method disclosed in 63-157722, it is disadvantageously difficult to detect the rising of pressure for a thin workpiece.

Further, as in the case of the method disclosed in 6-74746, if a point at which the difference between a linear scale value and an NC device instruction value occurs based on the backlash is determined as a point at which a punch contacts with a workpiece, "an excessive lash" which causes a backlash to enable detection is necessary. This makes it disadvantageously impossible to apply this method to a hydraulic bending machine.

Meanwhile, as shown in FIG. 1, if a workpiece W is bent by a punch P and a die D cooperatively in a press brake, for example, as a bending apparatus, a ram position detection means 103 for detecting the upper and lower positions of a ram 101 is provided so as to measure the distance between the punch P and the die D to thereby obtain a predetermined bending angle. A D-value is calculated in light of die conditions, workpiece conditions and the like, the ram position detection means 103 controls the D-value to bend the workpiece W.

However, even if the predetermined D-value is calculated and the relative distance of the punch P to the die D is controlled to obtain the D-value, mechanical deflections such as the deflections of side plates, those of upper and lower tables and that of the die occur due to the bending reaction of the workpiece W during the bending. Unless these deflections are corrected, bending with accurate angle cannot be ensured. However, it is quite difficult to accurately calculate and correct these mechanical deflections.

To solve this, as disclosed in, for example, Japanese Utility Model Application Publication No. 6-49374, there is proposed a bending method for directly detecting a D-value without the need to consider mechanical deflections. That is, as shown in FIG. 2, this position detection means 105 has a vertically movable detection pin 109 protruded from a V groove 107 of a die D and provided in the die D to be always urged upward, and detects the vertical movement of the detection pin 109 using a displacement gauge 111.

Therefore, if a punch P descends to thereby bend the workpiece W downward, then the lower surface of the workpiece W which is being bent is abutted on the detection pin 109 to press the pin 109 down. The descent of the detection pin 109 is detected by the displacement gauge 111 to thereby directly detect a D-value.

Even with the conventional art, however, it is difficult to accurately calculate the relative stroke value of the punch P to obtain a target bending angle because of the various characteristics of the workpiece W, e.g., spring-back by which if the workpiece W is unloaded after being bent, the bending angle recovers.

On the other hand, with both the method shown in 63-15772 and that shown in 6-74746 as described above, a phenomenon that the actual plate thickness of the workpiece changes (decreases) during bending occurs. According to each method, the D-value is calculated not in light of the decrease of the thickness but based on the detection of the position at which the punch contacts with the workpiece at the start of bending. Since the D-value is not calculated in light of the thickness change (decrease) after the bending completely starts, the method has a disadvantage in that a target angle cannot be accurately obtained.

The present invention has been made while paying attention to the above-stated conventional disadvantages and the object of the present invention is to provide a plate thickness detection method, a plate thickness detector, a reference inter-blade distance detection method and a reference inter-blade distance detector for a bending machine capable of accurately detecting the actual plate thickness of a workpiece during bending.

Further, the present invention has been made while paying attention to the above-stated conventional disadvantages and the object of the present invention is to provide a bending method and a bending apparatus capable of accurately calculating the relative stroke value of a punch for a target bending angle and carrying out bending with high accuracy.

DISCLOSURE OF THE INVENTION

To attain the above object, the invention is a plate thickness detection method for a bending machine causing a punch to make a relative stroke and bending a workpiece mounted on an upper surface of a die cooperatively by the punch and the die, characterized by relatively descending the punch from a reference position away from the die by a reference inter-blade distance; detecting a relative stroke quantity of the punch if a change in a displacement quantity of a displacement gauge provided in the die, always urged upward from a die V-groove, and measuring a distance to a lower surface of the workpiece is detected, or at a predetermined point after the detection, using a ram position detection means and detecting the displacement quantity of the displacement gauge at this time; and subtracting the detected relative stroke quantity from the reference inter-blade distance and adding the displacement quantity of the displacement gauge to the subtraction result, thereby detecting a plate thickness of the workpiece.

Further, the invention is characterized not only by the previously noted features of the invention, but also in that the reference inter-blade distance is a distance between the punch and the die at a top dead center before relatively descending the punch.

Further, the invention is characterized not only by the above-noted features of the invention, but also in that the reference inter-blade distance is calculated by mounting a workpiece having a known plate thickness on the die before actual bending, relatively descending the punch to detect the stroke quantity using ram position detection means and to detect the displacement quantity of the displacement gauge at this time, adding the plate thickness of the workpiece to the relative stroke quantity of the punch and subtracting the displacement quantity of the displacement gauge from the addition result.

To obtain the above object, the invention is a reference inter-blade distance detection method for obtaining a reference inter-blade distance which is a distance between a punch and a die at an arbitrary reference position, characterized by: mounting a workpiece having a known plate thickness on the die; relatively moving the punch to allow the punch to bend the workpiece cooperatively with the die; adding the known plate thickness to a stroke quantity of the punch at this time and subtracting a displacement quantity of a displacement gauge, provided in the die and detecting a distance from an upper surface of the die to a lower surface of the workpiece, from the addition result, thereby detecting the reference inter-blade distance.

To attain the above object, the invention is a plate thickness detector for a bending machine causing a punch to make a relative stroke and bending a workpiece mounted on an upper surface of a die cooperatively by the punch and the die, characterized by comprising: a displacement gauge provided in the die, always urged upward from a V-groove of the die, and measuring a distance from the upper surface of the die to a lower surface of the workpiece; ram position detection means for detecting a relative stroke quantity of the punch to the die; and a plate thickness arithmetic operation section calculating a plate thickness of the workpiece from a reference inter-blade distance which is a distance between the punch and the die, the distance being input or stored in storage means, a displacement quantity measured by the displacement gauge and the relative stroke quantity of the punch detected by the ram position detection means, and characterized in that the plate thickness arithmetic operation section detects the relative stroke quantity of the punch using ram position detection means at a point at which descent of the workpiece is detected by the displacement gauge or a predetermined point after the point after the punch is relatively descended from a position away from the die by the reference inter-blade distance, detects the displacement quantity of the displacement gauge at this time, and detects the plate thickness of the workpiece by subtracting the detected relative stroke quantity from the reference inter-blade distance and adding the displacement quantity to the subtraction result.

Further, the invention is characterized not only by the above-noted features of the invention, but also in that the reference inter-blade distance is a distance between the punch and the die at a top dead center before relatively descending the punch.

Further, the invention is characterized not only by the above-noted features of the invention, but also by, after a workpiece having a known plate thickness is mounted on the die before actual bending and the punch is relatively descended to detect the stroke quantity using the ram position detection means and to detect the displacement quantity of the displacement gauge at this time, further comprising a reference inter-blade distance arithmetic operation section for adding the plate thickness of the workpiece to the relative stroke quantity of the punch and subtracting the displacement quantity of the displacement gauge from the addition result, thereby calculating the reference inter-blade distance.

To attain the above object, the invention is a reference inter-blade distance detector for obtaining a reference inter-blade distance which is a distance between a punch and a die at an arbitrary reference position, characterized by comprising: a displacement gauge provided to be always urged upward in a V-groove of the die, and measuring a distance from an upper surface of the die to a lower surface of a workpiece; ram position detection means for detecting a relative stroke quantity of the punch; and a reference inter-blade distance arithmetic operation section, after a workpiece having a known plate thickness is mounted on the die and the punch is relatively moved to allow the punch to bend the workpiece in cooperation with the die, for adding the known plate thickness to a stroke quantity of the punch at this time and subtracting a displacement quantity of the displacement gauge from the addition result, and thereby detecting the reference inter-blade distance.

To attain the above object, the invention is a bending method for directly detecting a relative stroke value of a punch to a die using a vertically movable displacement gauge provided in the die and protruded from a V-groove of the die, and for controlling a relative stroke of the punch, characterized by: inputting various conditions including workpiece conditions, die conditions and a target bending angle; obtaining a corresponding relative stroke value of the punch based on the input target bending angle; causing the punch to make the relative stroke by the relative stroke value, and bending the workpiece cooperatively by the punch and the die; actually measuring a bending angle of the bent workpiece; and correcting the relative stroke value based on the actually measured bending angle and the target bending angle.

To attain the above object, the invention is a bending apparatus for directly detecting a relative stroke value of a punch to a die using a vertically movable displacement gauge provided in the die and protruded from a V-groove of the die, and for controlling a relative stroke of the punch, characterized by comprising: input means for inputting various conditions including workpiece conditions, die conditions and a target bending angle; stroke value calculation means for obtaining a corresponding relative stroke value of the punch based on the input target bending angle; bending means for causing the punch to make the relative stroke by the relative stroke value, and bending the workpiece cooperatively by the punch and the die; angle measurement means for actually measuring a bending angle of the bent workpiece; and correction means for correcting the relative stroke value based on the actually measured bending angle and the target bending angle.

To attain the above object, the invention is a bending method for directly detecting a relative stroke value of a punch to a die using a vertically movable displacement gauge provided in the die and protruded from a V-groove of the die, and for controlling a relative stroke of the punch, characterized by: inputting various conditions including workpiece conditions, die conditions and a target bending angle; obtaining the relative stroke value of the punch corresponding to the input conditions from data stored in a database in advance or a theoretical expression based on an experiment; causing the punch to make the relative stroke by the relative stroke value, and bending the workpiece cooperatively by the punch and the die; actually measuring a bending angle of the bent workpiece; and if a difference between the actually measured bending angle and the target bending angle is not within a tolerance, correcting the data stored in the database based on the difference; correcting the relative stroke value based on the corrected data; further bending the workpiece based on the corrected relative stroke quantity; and repeating correcting the data and further bending the workpiece until the difference between the actually measured bending angle and the target bending angle falls within the tolerance.

Further, the invention is characterized not only by the above-noted features of the invention, but also in that if the data in the database is to be corrected, the data is corrected by displacing the data by the difference between the actually measured bending angle and the target bending angle.

Further, the invention is characterized not only by the above-noted features of the invention, but also in that if the data in the database is to be corrected, the data is corrected by displacing the data by a quantity proportional to the difference between the actually measured bending angle and the target bending angle.

To attain the above object, the invention is a bending apparatus for directly detecting a relative stroke value of a punch to a die using a vertically movable displacement gauge provided in the die and protruded from a V-groove of the die, and for controlling the relative stroke of the punch, characterized by comprising: input means for inputting various conditions including workpiece conditions, die conditions and a target bending angle; a database storing the relative stroke value of the punch corresponding to the various conditions or an expression for calculating the relative stroke value of the punch corresponding to the various conditions; stroke value calculation means for obtaining the relative stroke value of the punch corresponding to the input conditions from the data stored in the database; a stroke instruction section for causing the punch to make the relative stroke by the relative stroke value; a comparison determination section for actually measuring a bending angle of the bent workpiece, and determining whether or not a difference between the actually measured bending angle and the target bending angle is within a tolerance; and a data correction section for, it the difference between the actually measured bending angle and the target bending angle is not within the tolerance, correcting the data stored in the database based on the difference, and characterized in that the stroke value calculation means corrects the relative stroke value based on the corrected data, and the stroke instruction section causes the punch to make the relative stroke by the corrected relative stroke value, thereby repeatedly correcting the relative stroke value and causing the punch to make a stroke by the stroke instruction section until the difference between the actually measured bending angle and the target bending angle falls within the tolerance.

Further, the invention is characterized not only by the above-noted features of the invention, but also in that the data correction section corrects the data by displacing the data by the difference between the actually measured bending angle and the target bending angle.

Further, the invention is characterized not only by the above-noted features of the invention, but also in that the data correction section corrects the data by displacing the data by a quantity proportional to the difference between the actually measured bending angle and the target bending angle.

To attain the above object, the invention is a bending method for directly detecting a relative stroke value of a punch to a die using a vertically movable displacement gauge provided in the die and protruded from a V-groove of the die, and for controlling a relative stroke of the punch, characterized by: inputting various conditions including workpiece conditions, die conditions and a target bending angle; obtaining the relative stroke value of the punch corresponding to the input target bending angle from a stroke value-to-angle relationship stored in a database in advance; causing the punch to make the relative stroke by the relative stroke value, and bending the workpiece cooperatively by the punch and the die; measuring a bending load for a certain stroke value before a stroke value reaches a target stroke value, comparing the measured bending load with the stroke value-to-angle relationship stored in the database in advance, and correcting the stroke value-to-angle relationship stored in the database; correcting the target stroke value from the corrected stroke value-to-angle relationship; and bending the workpiece using the corrected stroke value-to-angle relationship as a target.

To attain the above object, the invention is a bending apparatus for directly detecting a relative stroke value of a punch to a die using a vertically movable displacement gauge provided in the die and protruded from a V-groove of the die, and for controlling a relative stroke of the punch, characterized by comprising: input means for inputting various conditions including workpiece conditions, die conditions and a target bending angle; a database storing the input various data, a stroke value-to-angle relationship and a stroke value-to-load relationship both obtained in advance; stroke value calculation means for obtaining the relative stroke value of the punch corresponding to the target bending angle from the stroke-value-to-angle relationship stored in the database; a stroke instruction section controlling driving means so as to cause the punch to make the relative stroke for the obtained relative stroke value; load detection means for detecting a bending load at a certain stroke position until a stroke value reaches the target stroke value; and a stroke value-to-angle correction section for correcting the stroke value-to-angle relationship stored in the database based on the bending load detected by the bending load detection means, and characterized in that the stroke value calculation means obtains a new relative stroke value from the stroke value-to-angle relationship corrected by the stroke value-to-angle correction section.

To attain the above object, the invention is a bending method for causing a punch to make a relative stroke based on input bending data including workpiece conditions, die conditions and bending conditions, for directly detecting a relative stroke value of the punch to a die using a vertically movable displacement gauge provided in the die and protruded from a V-groove of the die, and for controlling the relative stroke of the punch, characterized by: measuring a before-bending plate thickness of the workpiece; calculating a spring back quantity of the workpiece based on the measured before-bending plate thickness of the workpiece and the bending data; calculating an insertion angle based on the calculated spring back quantity; calculating the relative stroke quantity of the punch for bending the workpiece for the insertion angle; calculating a radius of curvature of the workpiece right under the punch if the workpiece is bent for the insertion angle; calculating an after-bending plate thickness of the workpiece when the workpiece has been bent, based on the calculated radius of curvature of the workpiece and the before-bending plate thickness of the workpiece; calculating a final stroke value of the punch based on the before-bending plate thickness of the workpiece, the after-bending plate thickness of the workpiece and the insertion angle; and relatively moving the punch to obtain the final stroke value and thereby bending the workpiece while monitoring the stroke using the displacement gauge.

To attain the above object, the invention is a bending apparatus for causing a punch to make a relative stroke based on bending data including workpiece conditions, die conditions and bending conditions input by input means, for directly detecting a relative stroke value of the punch to a die using a vertically movable displacement gauge provided in the die and protruded from a V-groove of the die, and for controlling the relative stroke of the punch, characterized by comprising: plate thickness measurement means for measuring a before-bending plate thickness of the workpiece; spring back quantity arithmetic operation means for calculating a spring back quantity of the workpiece based on the measured before-bending plate thickness of the workpiece and the bending data; insertion angle arithmetic operation means for calculating an insertion angle based on the calculated spring back quantity; stroke arithmetic operation means for calculating the relative stroke quantity of the punch for bending the workpiece for the insertion angle; workpiece radius-of-curvature arithmetic operation means for calculating a radius of curvature of the workpiece right under the punch if the workpiece is bent for the insertion angle; plate thickness arithmetic operation means for calculating an after-bending plate thickness of the workpiece when the workpiece has been bent, based on the calculated radius of curvature of the workpiece and the before-bending plate thickness of the workpiece; final stroke arithmetic operation means for calculating a final stroke value of the punch based on the before-bending plate thickness of the workpiece, the after-bending plate thickness of the workpiece and the insertion angle; and a stroke instruction section for relatively moving the punch based on the final stroke value and bending the workpiece while monitoring the stroke using the displacement gauge.

BEST MODES FOR CARRYING OUT THE INVENTION

The embodiments of the present invention will be described hereinafter in detail with reference to the drawings.

Figure 1:
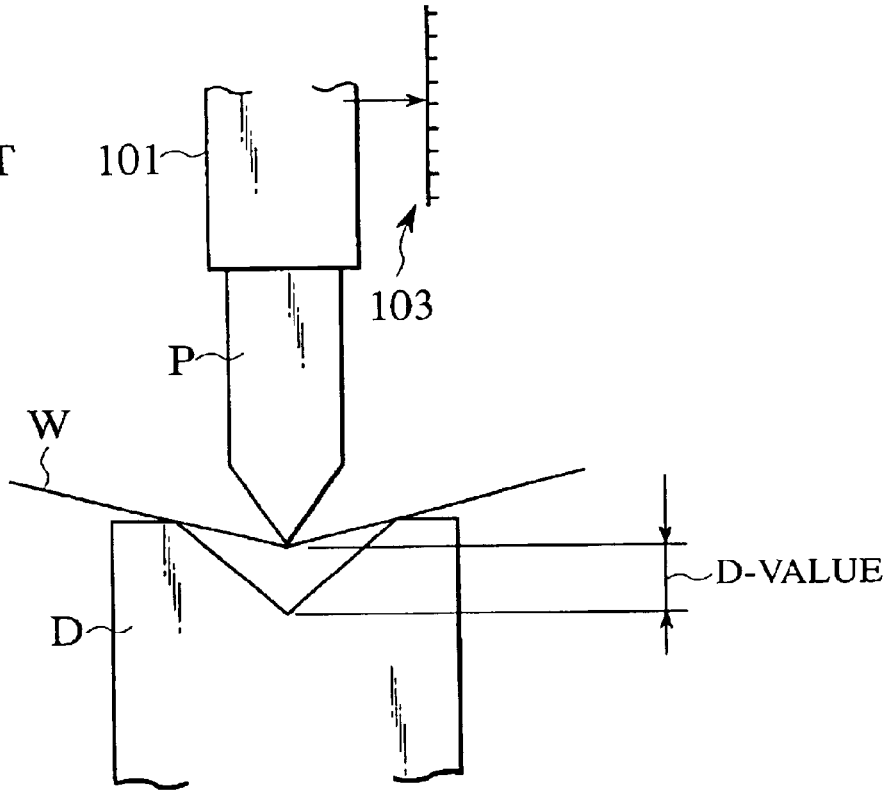
FIG. 1 PRIOR ART
FIG. 1 is an explanatory view showing a D-value detection method for a conventional bending apparatus.
Figure 2:
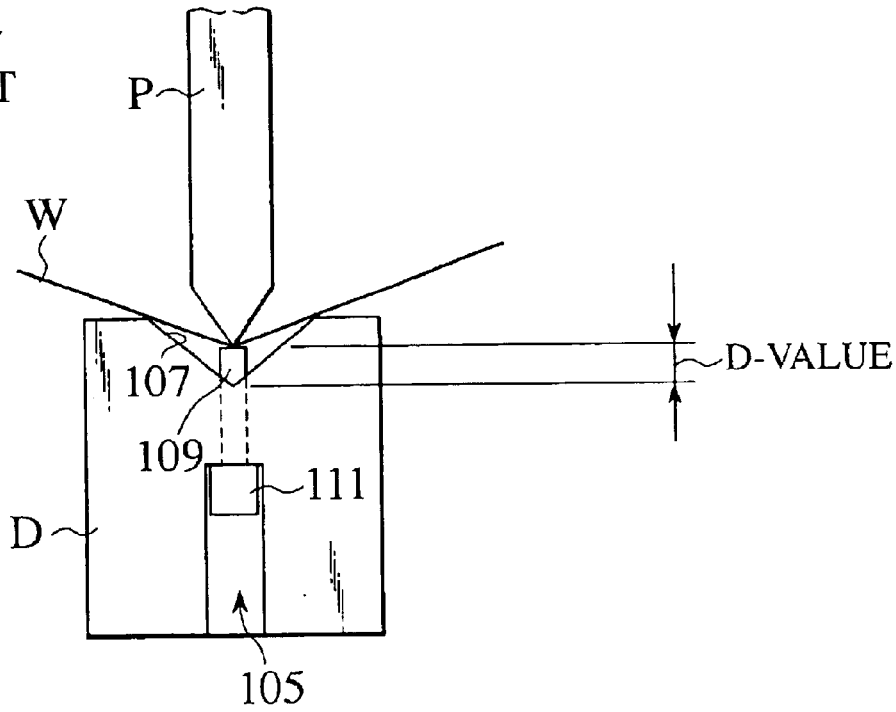
FIG. 2 PRIOR ART
FIG. 2 is a cross-sectional view showing a conventionally known displacement gauge for directly measuring a D-value.

FIGS. 1 and 2 show a press brake 1 which serves as a bending apparatus according to the present invention. Since the press brake 1 is already well known, it will be described only schematically.

The press brake 1 has left and right side plates 3L and 3R each of which has a gap G in a central portion on entire surfaces and is generally C shaped, and an upper table 5U which serves as a ram is provided to be vertically movable on the front surface of the upper portion of each of the side plates 3L and 3R. This upper table 5U has a punch P which is attached to the lower end of the table 5U through an intermediate plate 7 in an exchangeable fashion and is vertically moved by a ram driving means 9 including a hydraulic cylinder, a motor, a ball spring and so on provided on the upper portion of each of the side plates 3L and 3R. A ram position detection means 11 such as an encoder or linear scale for detecting the upper and lower positions of the upper table 5U is provided. Further, a bending load detector which serves as a bending load detection means is attached to the ram driving means 9.

On the other hand, a lower table 5L is provided on the front surface of the lower portion of each of the side plates 3L and 3R, and a die D is attached to the upper end of this lower table 5L through a die holder 13 in an exchangeable fashion. A V-groove 15 (see FIGS. 5 and 6) for bending a workpiece W is provided on the upper portion of the die D in the longitudinal direction of the die D. Further, a controller 17 controlling the ram driving means 9 and the like, to be described later, is provided in the vicinity of the press brake 1.

With the above-stated configuration, the punch P is descended by the ram driving means 9 toward the workpiece W which is positioned between the punch and the die D, the ram position detection means 11 detects the upper and lower positions of the upper table 5 which serves as a ram, the controller 17 controls the position of the punch P, and the punch P and the die D cooperatively bend the workpiece W.

Figure 5:
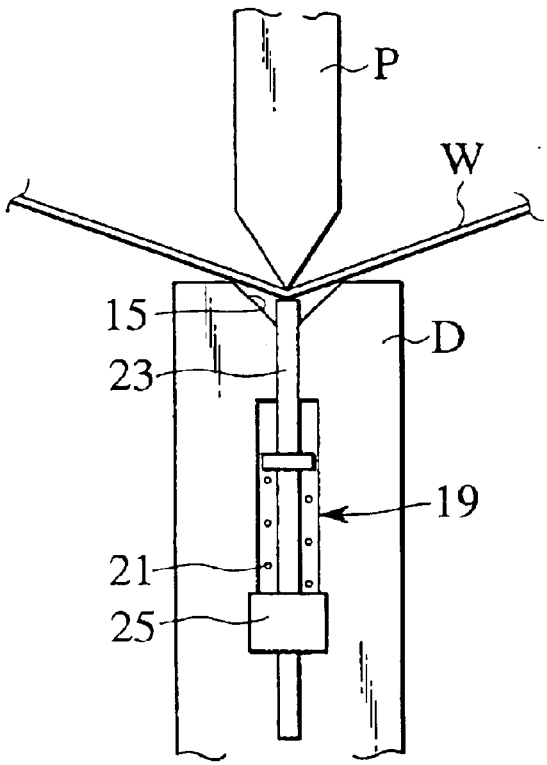
FIG. 5 is a cross-sectional view showing a displacement gauge.

Referring also to FIG. 5, a plurality of displacement gauges 19 are provided in the die D in the longitudinal direction of the die D. Each of the displacement gauges 19 is provided with a detection pin 23 which is always urged upward by a spring 21 and which is protruded vertically movably from the V groove 15 of the die D, and with a linear scale 25 for detecting the upper and lower positions of the detection pin 23.

Figure 6:
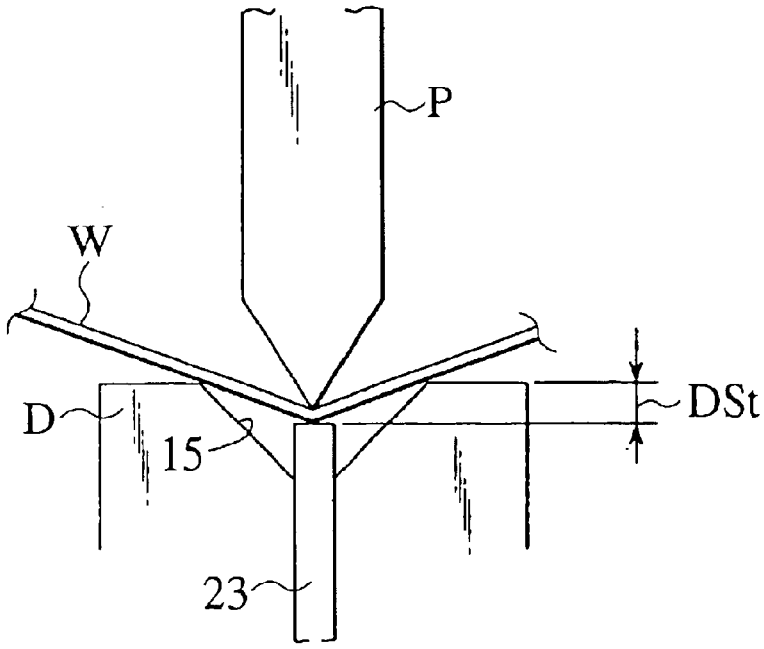
FIG. 6 is an explanatory view showing an inter-blade distance.

Accordingly, the workpiece W which is bent by the punch P presses the detection pin 23 down, the linear scale 25 detects the upper and lower positions of the detection pin 23 at the time of being pressed, and, as shown in FIG. 6, the distance DSt between the upper end portion of the detection pin 23 and the upper surface of the die D is detected.

A plate thickness detection method, a plate thickness detector, a reference inter-blade distance detection method and a reference inter-blade distance detector as the first embodiment of the present invention will first be described with reference to FIGS. 7 to 15.

Figure 7:
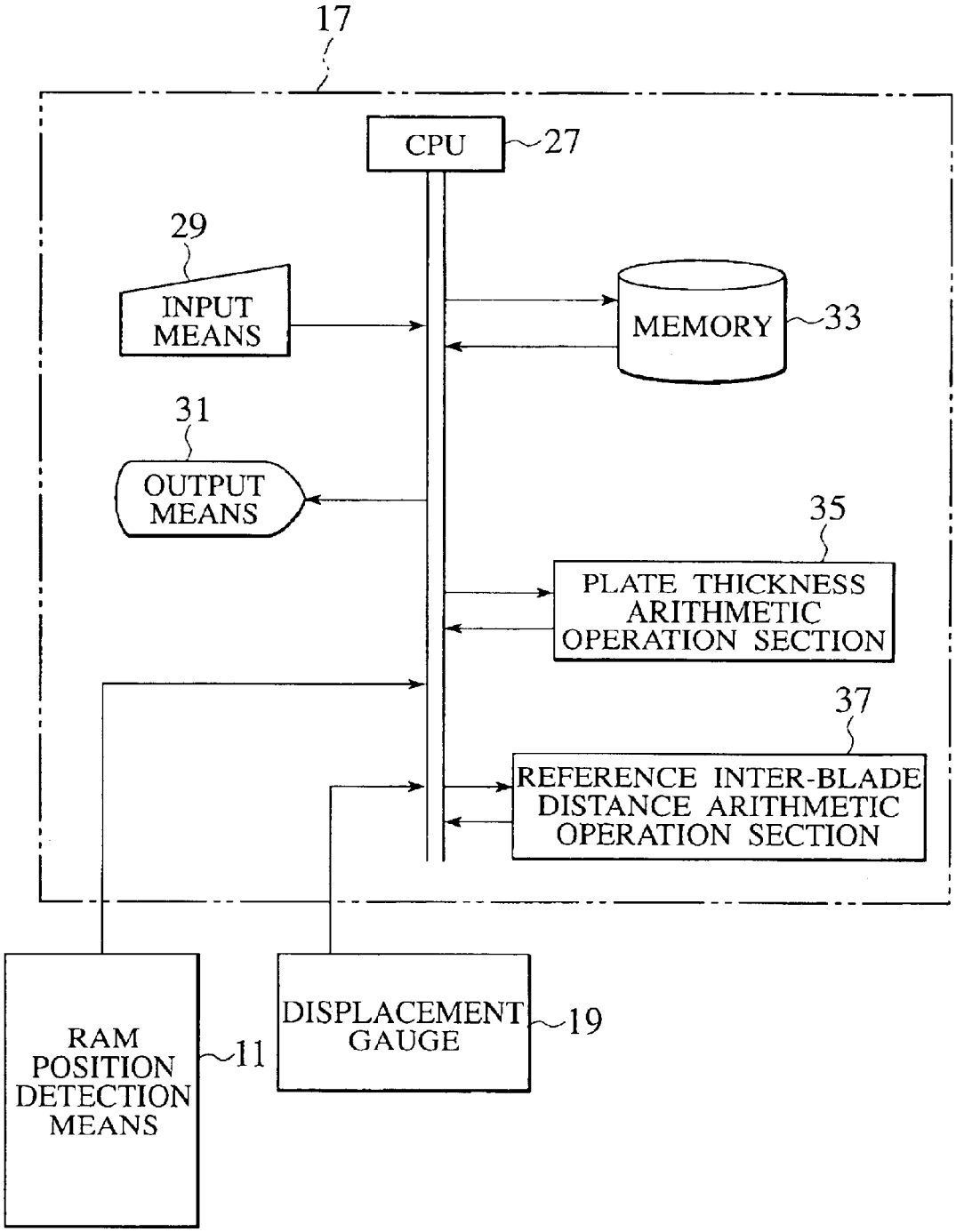
FIG. 7 is a block diagram showing the configuration of a controller which serves as a plate thickness detector in a bending machine according to the present invention.

FIG. 7 shows a block diagram of the controller 17. This controller 17 includes a CPU 27 or a central processing unit, to which an input means 29 such as a keyboard for inputting various data and an output means 31 such as a CRT for displaying the various data are connected. Further, the ram position detection means 11 and the displacement gauges 19 are connected to the CPU 27 so that a detection signal can be transmitted to the CPU 27.

Furthermore, a memory 33 storing the various data and a plate thickness arithmetic operation section 35 which calculates the plate thickness of the workpiece W mounted on the die D from the stroke quantity of the punch P detected by the ram position detection means 11 and the movement quantities of the displacement gauges 19 detected by the displacement gauges 19 as will be described later, are connected to the CPU 27. As will be described later, a reference inter-blade distance arithmetic operation section 37 which calculates a reference inter-blade distance which is the inter-blade distance between the punch P and the die D as a reference to be employed for the arithmetic operation of the plat thickness, is also connected to the CPU 27.

A method for measuring the plate thickness T of the workpiece W will next be described.

Figure 3:
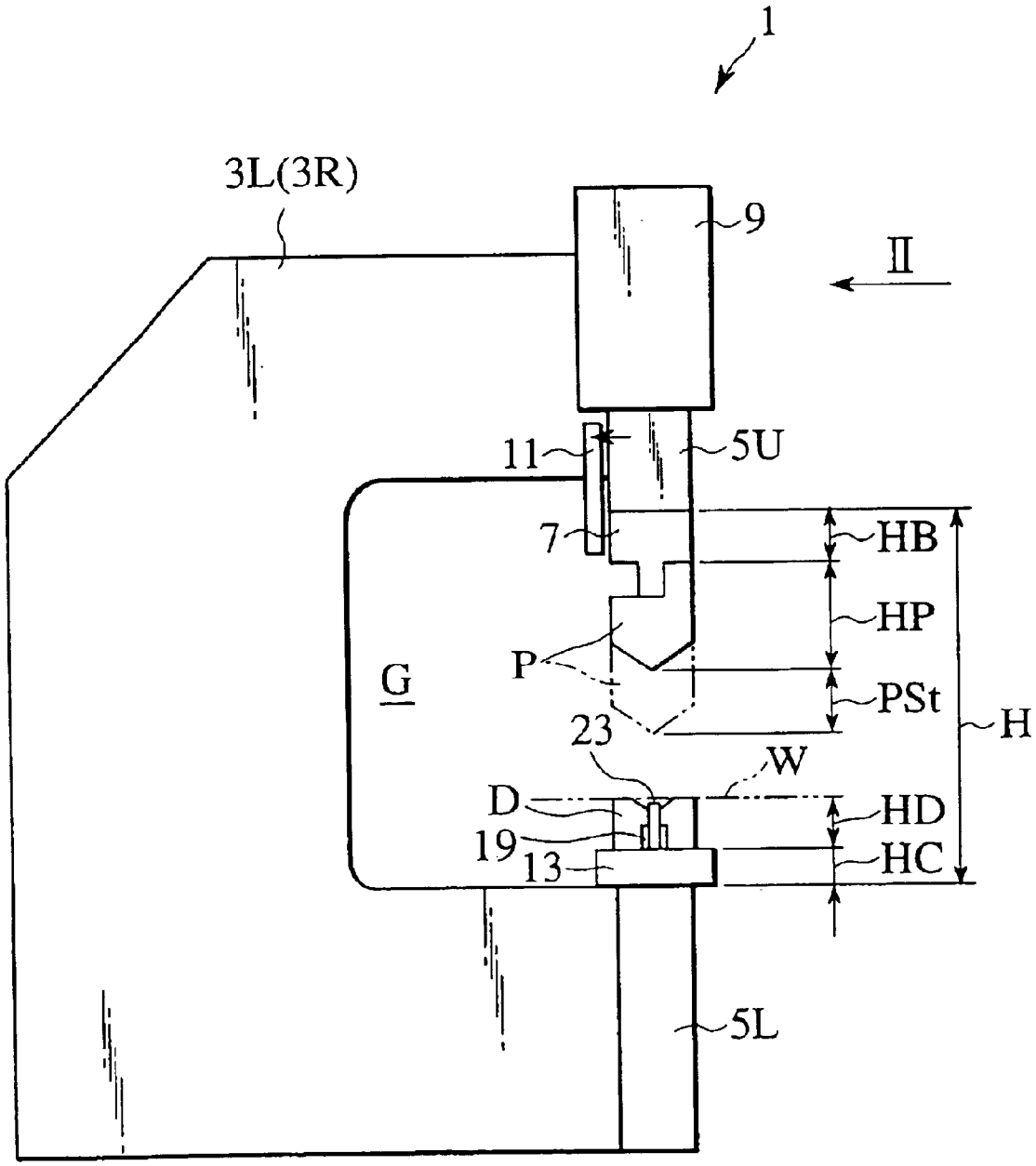
FIG. 3 is a front view of a press brake which is a bending apparatus according to the present invention.
Figure 4:
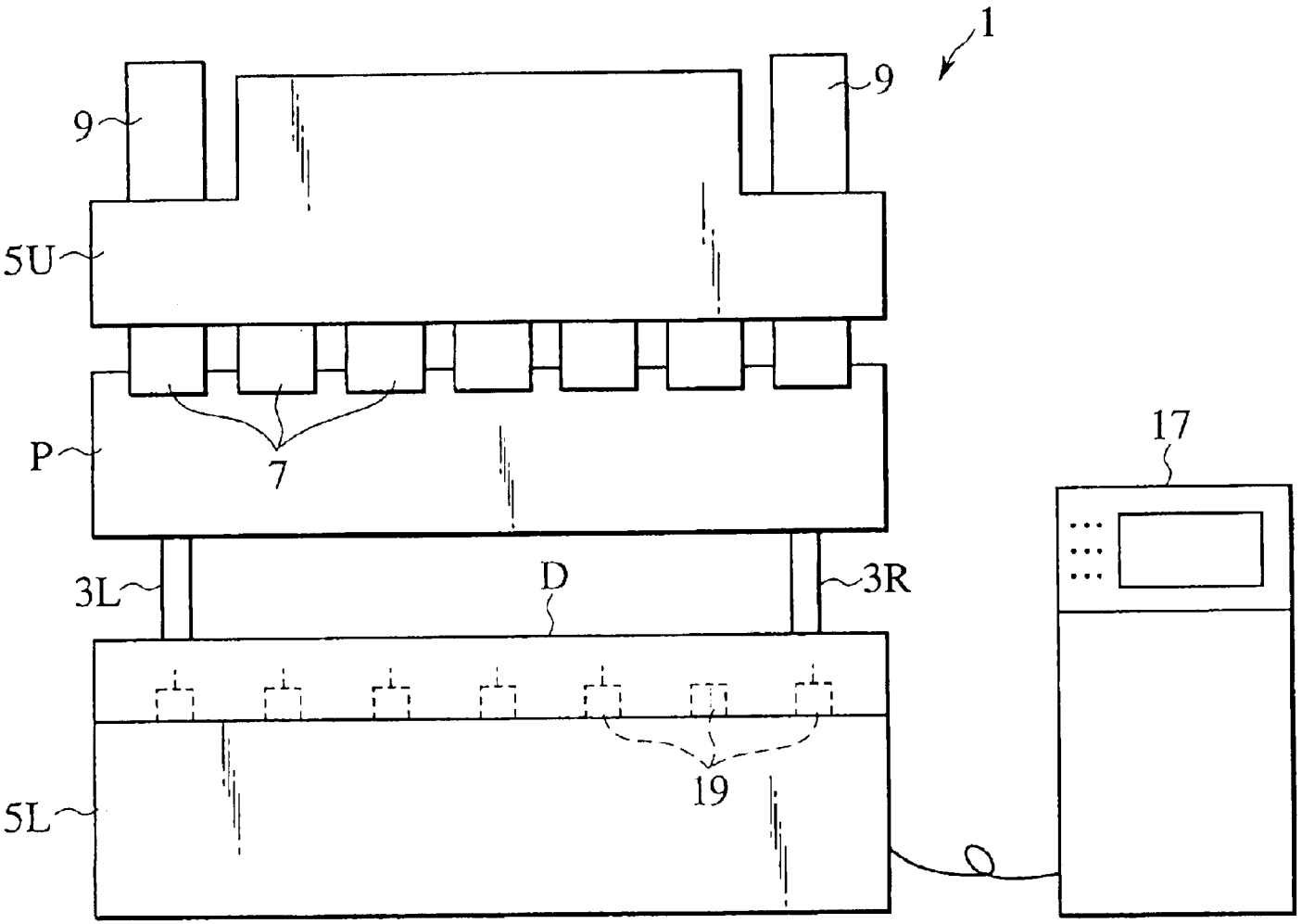
FIG. 4 is a side view of the press brake viewed from a direction II shown in FIG. 3.

First, a method for measuring the plate thickness of the workpiece W by descending the ram from a top dead center (i.e., the top dead center of the punch P) will be described. Referring to FIG. 3, in the press brake 1, an open height is denoted by H, the height of an intermediate plate 7 is denoted by HB, the height of the punch P is denoted by HP, the height of the die D is denoted by HD and the height of the die holder 13 is denoted by HC. Accordingly, these are known values in the press brake 1 and so is well known the reference inter-blade distance=H−HB−HP−HC−HD. Further, the stroke of the punch P from the top dead center in a downward direction is denote by PSt as shown in FIG. 3, and that of the detection pin 23 from the upper surface of the die D in the downward direction is denoted by DSt as shown in FIG. 6.

Figure 8:
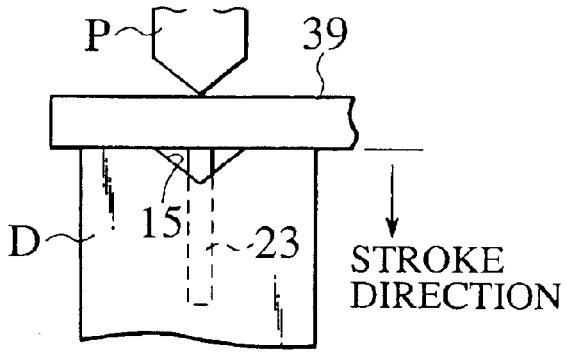
FIG. 8 is a cross-sectional view showing the calibration of the displacement gauge.
Figure 9:
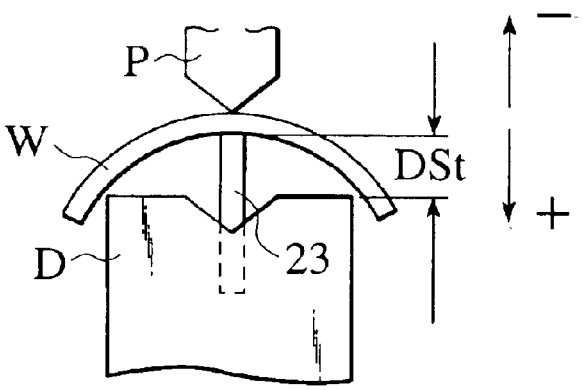
FIG. 9 is a cross-sectional view of an upward convex workpiece.
Figure 10:
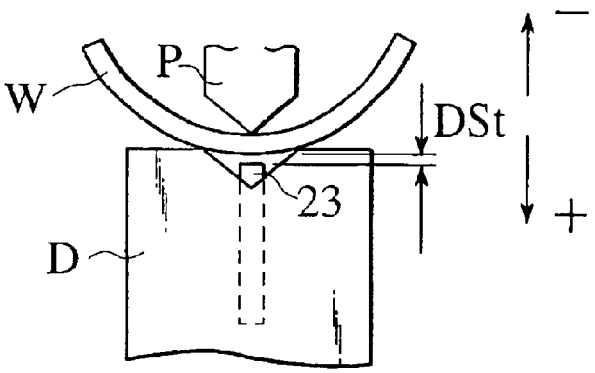
FIG. 10 is a cross-sectional view of a downward convex workpiece.

Referring to FIG. 8, the displacement gauge 19 measures the stroke DSt downward with the upper surface position of the die D set as an origin. Using a calibration tool 39 having a polished lower surface, this displacement gauge 19 obtains the origin in advance. Therefore, as shown in FIG. 9, if the workpiece W is warped to be convex upward, the sign of the initial value of DSt is minus. As shown in FIG. 10, if the workpiece W is warped to be convex downward, the sign of the initial value of DSt is plus.

Figure 11:
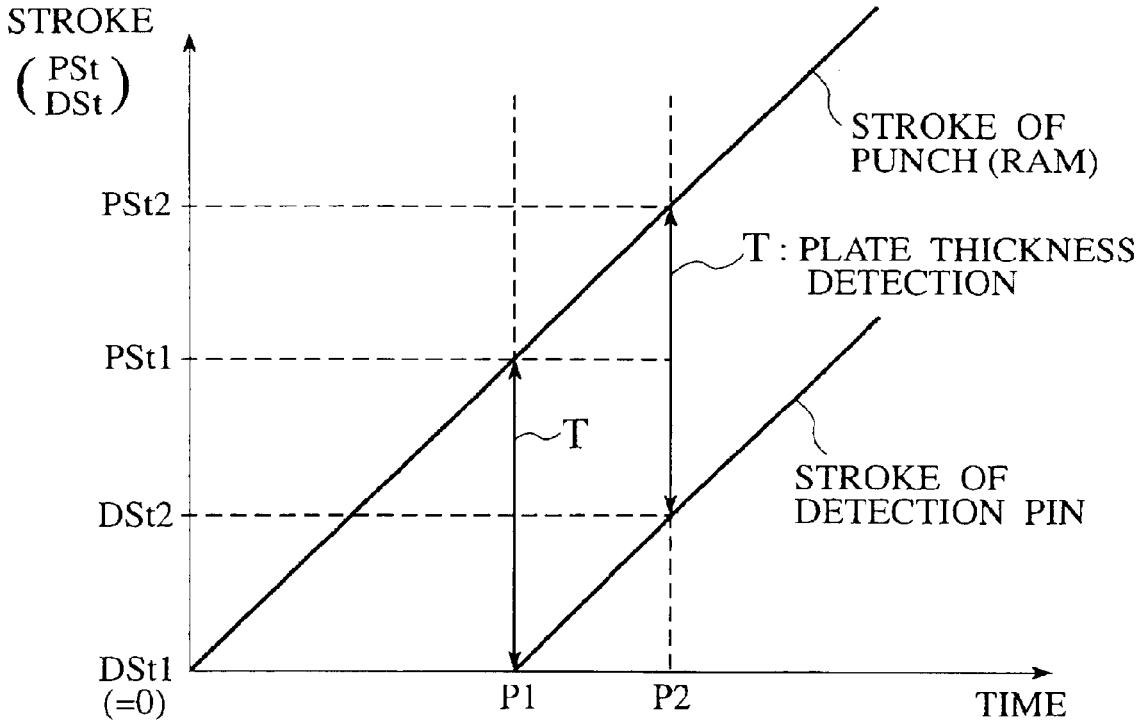
FIG. 11 is a graph showing the relationship between the stroke of a punch and the stroke of a displacement gauge.

FIG. 11 shows the relationship between the stroke PSt of the punch P and the stroke DSt of the detection pin 23 relative to time. In FIG. 11, a point P1 denotes the contact point between the punch P and the workpiece W and a point P2 denotes a predetermined point after bending starts. In addition, a stroke PSt1 denotes the stroke value of the punch P relative to the point P1, a stroke PSt2 denotes the stroke value of the punch P relative to the point P2, a stroke DSt1 (=0) denotes the stroke value of the detection pin 23 relative to the point P1 and a stroke DSt2 denotes the stroke value of the detection pin 23 relative to the point P2.

Figure 12:
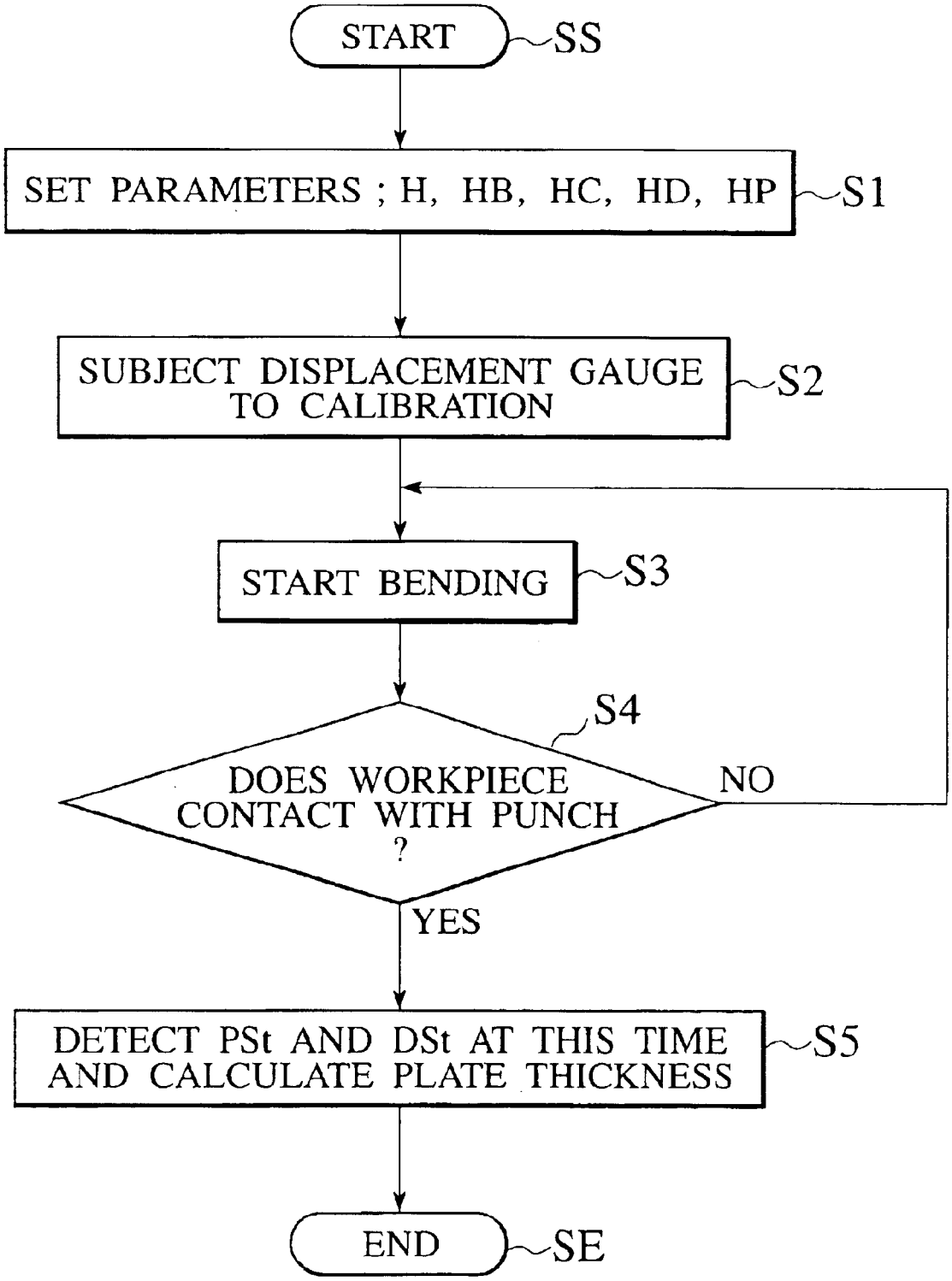
FIG. 12 is a flow chart showing a plate thickness detection method for the bending machine according to the present invention.

Referring to FIG. 12, if the plate thickness detection starts (in a step SS), the values of the open height H, the height HB of the intermediate plate 7, the height HP of the punch P, the height HD of the die D and the height HC of the die holder 13 are input (in a step S1). If these values are already input and stored in the memory 33, they are invoked.

As already stated above, using the calibration tool 39 having a polished lower surface, the displacement gauge 19 is subjected to calibration (in a step S2). Namely, the upper surface position of the die D is set at DSt=0.

The upper table 5U, as a ram, is descended by the ram driving means 9 to start bending (in a step S3), it is determined whether or not the punch P contacts with the workpiece W (or whether or not the punch P contacts with the workpiece W and then bent by a certain quantity as indicated by the point P2 shown in FIG. 11) (in a step S4), and the upper table 5U is descended back to the step S3.

In the step S4, if it is determined that the punch P contacts with the workpiece W, the stroke value PSt of the punch P and the stroke value DSt of the detection piece 23 at the time of the determination are obtained, and the plate thickness T of the workpiece W is obtained from T=H−(HB+HP+HD+HC+PSt)+DSt (in a step S5, see FIG. 3), thereby completing the measurement of the plate thickness (in a step SE).

If the determination is made with reference to the contact between the punch P and the workpiece W, the PSt1 and DSt1 (=0) are employed as PSt and DSt, respectively. If the determination is made with reference to the progress of bending by a certain degree, the PSt2 and DSt2 are employed as PSt and DSt, respectively. However, if the bending progresses so largely, the plate thickness is decreased by the bending. It is, therefore, desirable to detect the plate thickness so as not to excessively bend the workpiece W.

Since the plate thickness T of the workpiece W is calculated using the open height H, it is desirable that the frames such as the side plates 3L and 3R of the press brake 1 are less thermally deformed so as not to change the open height H. That is, a press brake of such a type as to drive a hydraulic cylinder by a bidirectional pump as the ram driving means 9 (hybrid press brake) is suitable.

Next, a method for measuring the plate thickness T of the workpiece W without reference to the top dead center of the ram as described above will be described. In this method, a reference inter-blade distance a is set as a reference.

Figure 13:
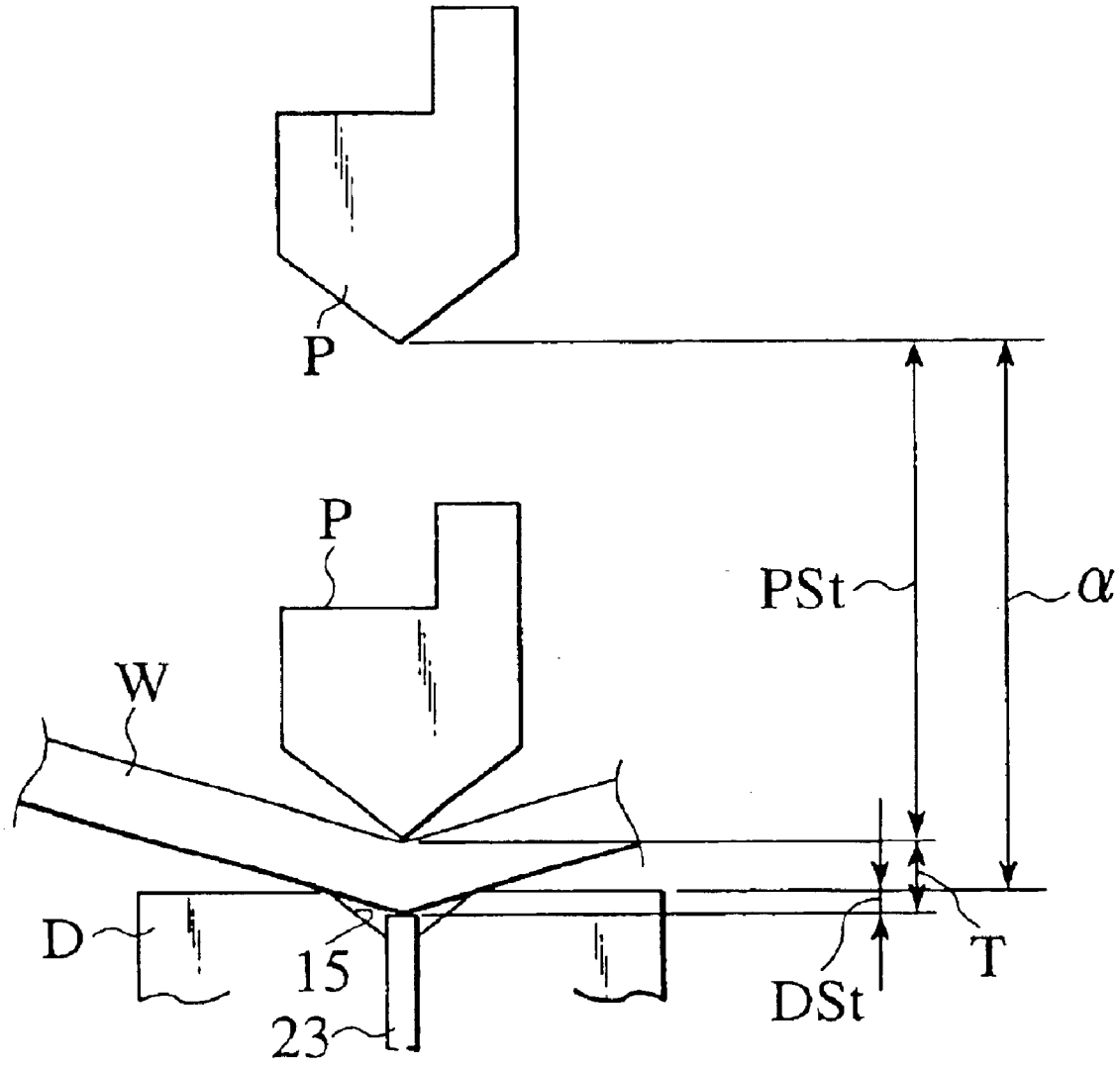
FIG. 13 is an explanatory view for a reference inter-blade distance.

Referring to FIG. 13, using a workpiece W the plate thickness T0 of which is known, the reference inter-blade distance a is obtained from a=PSt+T0−DSt and stored in the memory 33. Thereafter, the punch P is descended toward the workpiece W for which the plate thickness T is to be measured and the plate thickness T is obtained from T=a−(PSt−DSt).

Figure 14:
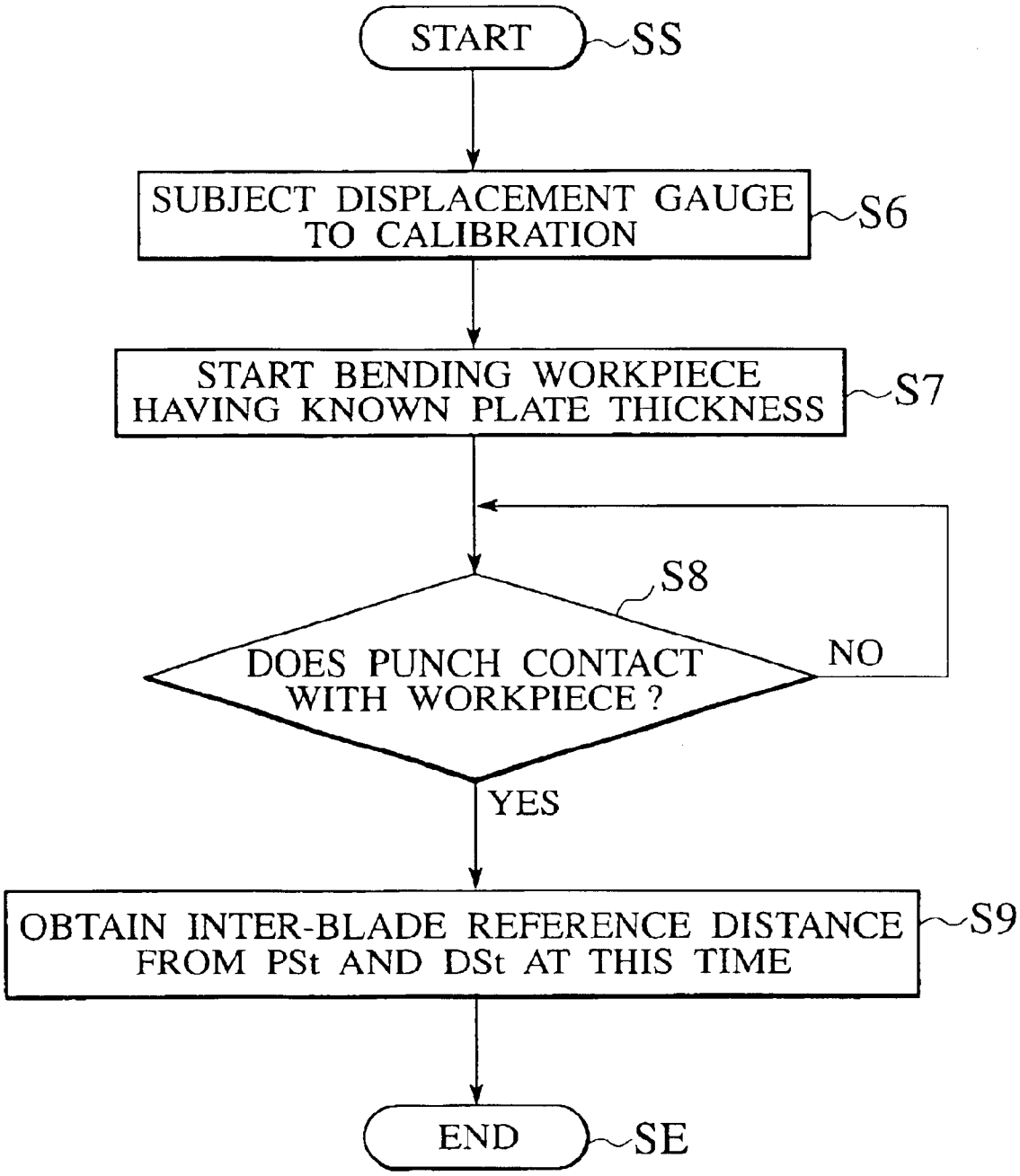
FIG. 14 is a flow chart showing calibration bending.

Referring to FIG. 14, if calibration bending starts (in a step SS), the displacement gauge 19 is subjected to calibration with reference to the upper surface of the die D as already described (in a step S6).

Bending starts to the workpiece W having the known plate thickness T0 (in a step S7) and it is determined whether or not the punch P contacts with the workpiece W (in a step S8). If the punch P does not contact with the workpiece W, the processing returns to the step S7, in which the punch P is descended. If it is determined that the punch P contacts with the workpiece W, then the stroke value PSt of the punch P and the stroke value DSt of the displacement gauge 19 at the time of the contact are obtained, the reference inter-blade distance a is calculated from a=PSt+T0−DSt (in a step S9) and the calibration bending is thereby ended (in a step SE).

Figure 15:
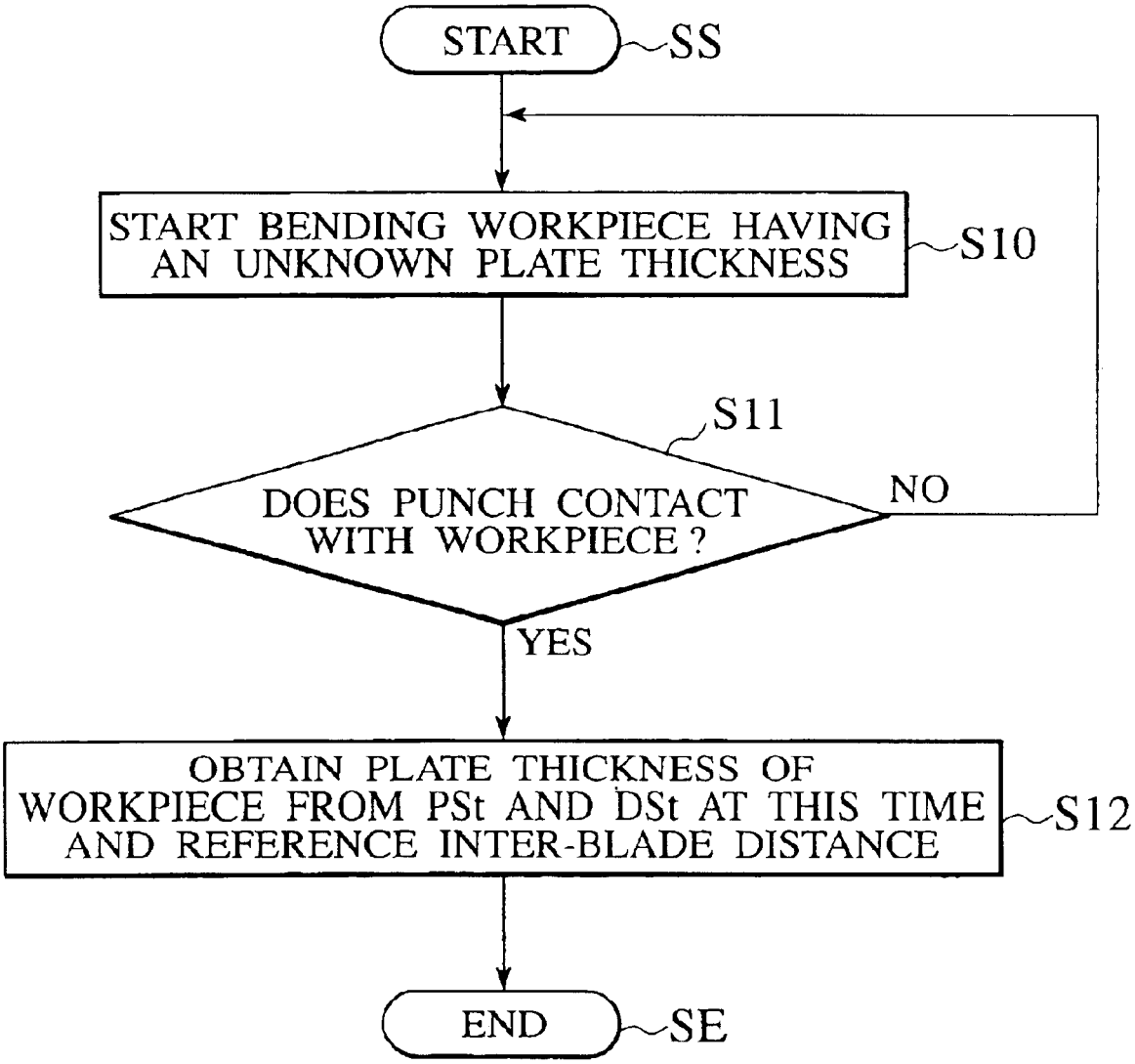
FIG. 15 is a flow chart showing product bending.

Referring next to FIG. 15, if product bending starts (in a step SS), the punch P is descended toward the workpiece W the plate thickness T of which is unknown to conduct bending (in a step S10). It is determined whether or not the punch P contacts with the workpiece W (in a step S11) and the punch P is descended until it contacts with the workpiece W. If the punch P contacts with the workpiece W, then the stroke PSt of the punch P and the stroke DSt of the detection pin 23 of the displacement gauge 19 at the time of the contact are obtained, the plate thickness T is obtained from T=a−(PSt−DSt) (in a step S12) and the product bending is ended (in a step SE).

If the plate thickness T is obtained as stated above, the plate thickness T can be measured without giving consideration to the influence of the thermal deformations of the frames of the press brake 1 as described above. Further, since the ram top dead center is not set as a reference, it is possible to cause the punch P to make a stroke from an arbitrary position and to measure the plate thickness T.

The above-stated results evidence that the plate thickness T can be detected if the stroke PSt of the punch P and the stroke DSt of the detection pin 23 of the displacement gauge 19 can be detected at the same time after bending starts. Therefore, it is possible to measure the plate thickness T at a bending start point, a point at which bending progresses by a certain degree (or a point at which a bending quantity exceeds a certain threshold) or the like.

Furthermore, as shown in FIGS. 9 and 10, even if the workpiece W is warped, it is possible to accurately measure the plate thickness T.

Referring to FIGS. 16 to 21, a bending method and a bending apparatus according to the second embodiment of the present invention will next be described.

Figure 16:
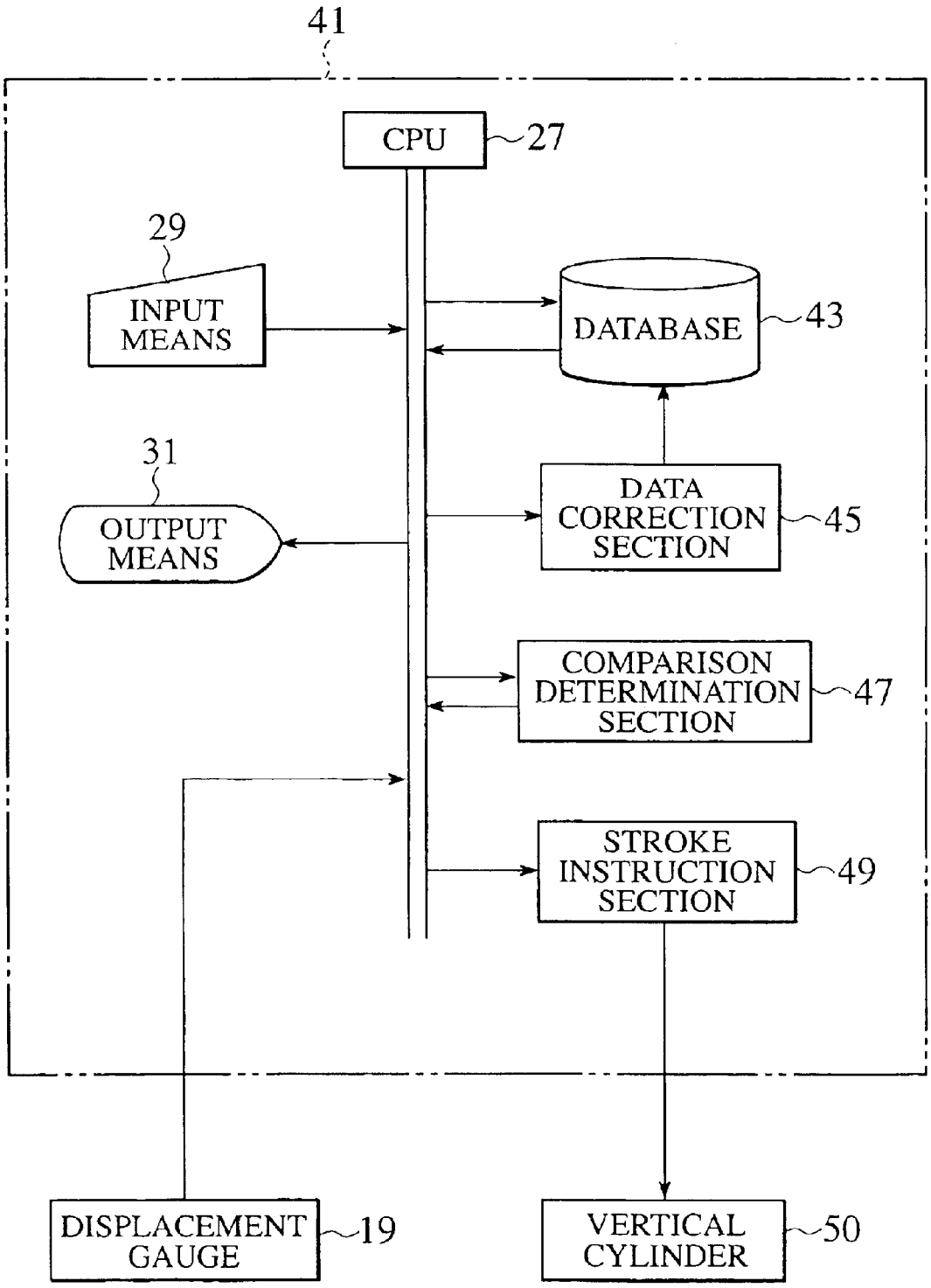
FIG. 16 is a block diagram showing the configuration of a controller in the second embodiment.
Figure 17:
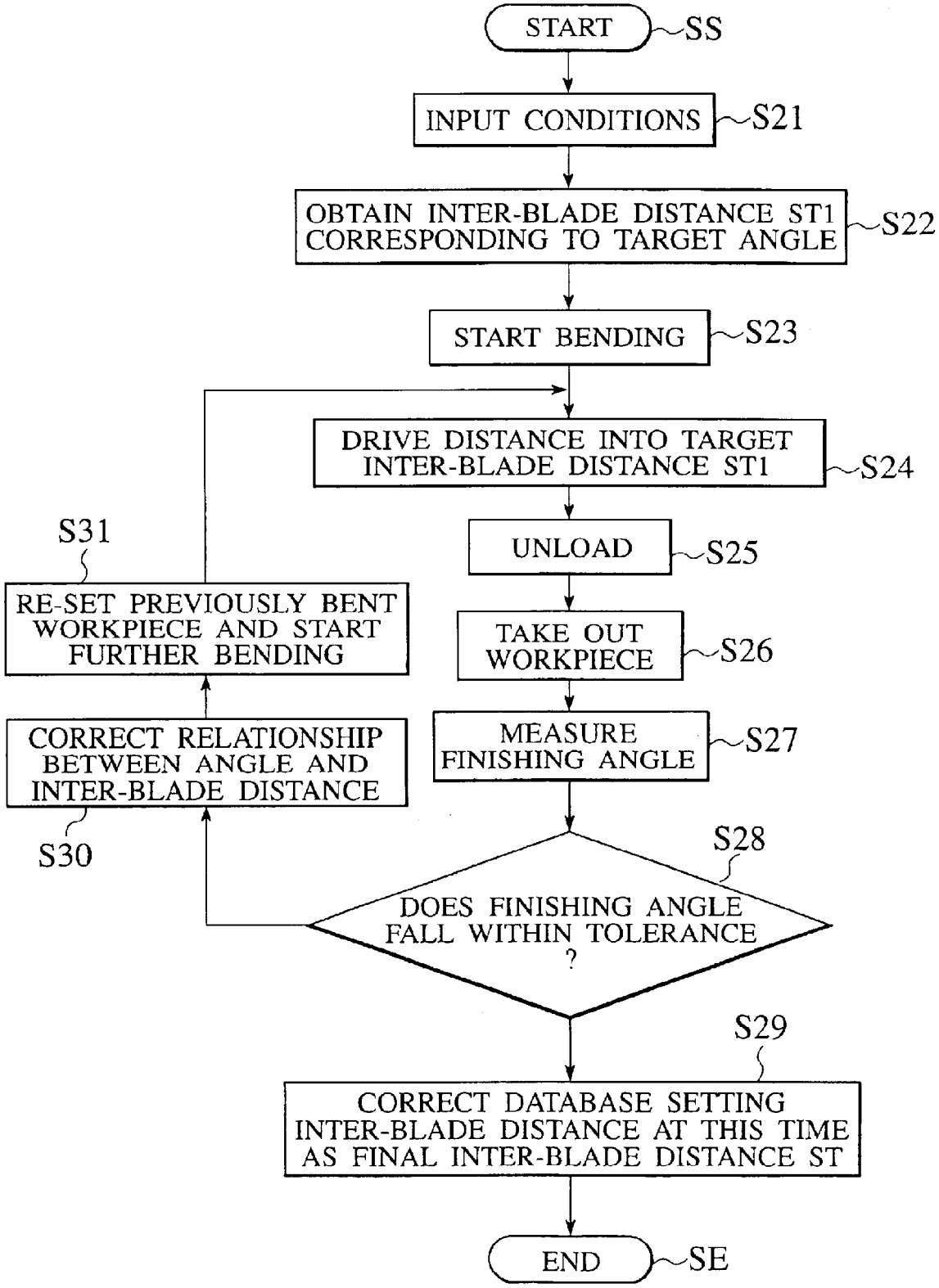
FIG. 17 is a flow chart showing the steps of a bending method according to the second embodiment.

Referring first to FIG. 16, a controller 41 includes a CPU 27 or a central processing unit, to which an input means 29 such as a keyboard for inputting various data and an output means 31 such as a CRT for displaying the various data are connected. In addition, a database 43 which will be described later, a data correction section 45 correcting the database 43 by a method which will be described later, a comparison determination section 47 comparing the measured bending angle of the bent workpiece W with a target angle, and a stroke instruction section 49 controlling a vertical cylinder 50 and thereby controlling the stroke of the punch P, are connected to the CPU 27. Further, a displacement gauge 19 is connected so that a detection signal can be transmitted.

Referring to FIGS. 17 to 21, the bending method according to the second embodiment will next be described.

When a processing starts (in a step SS), bending conditions such as a bending angle, die conditions including a die groove angle DA, a die V width V, a die shoulder are DR and a punch tip end are PR, material conditions including an n-power law hardening exponent, Young's modulus E and a plastic coefficient F, and the plate thickness are input (in a step S21).

Figure 18:
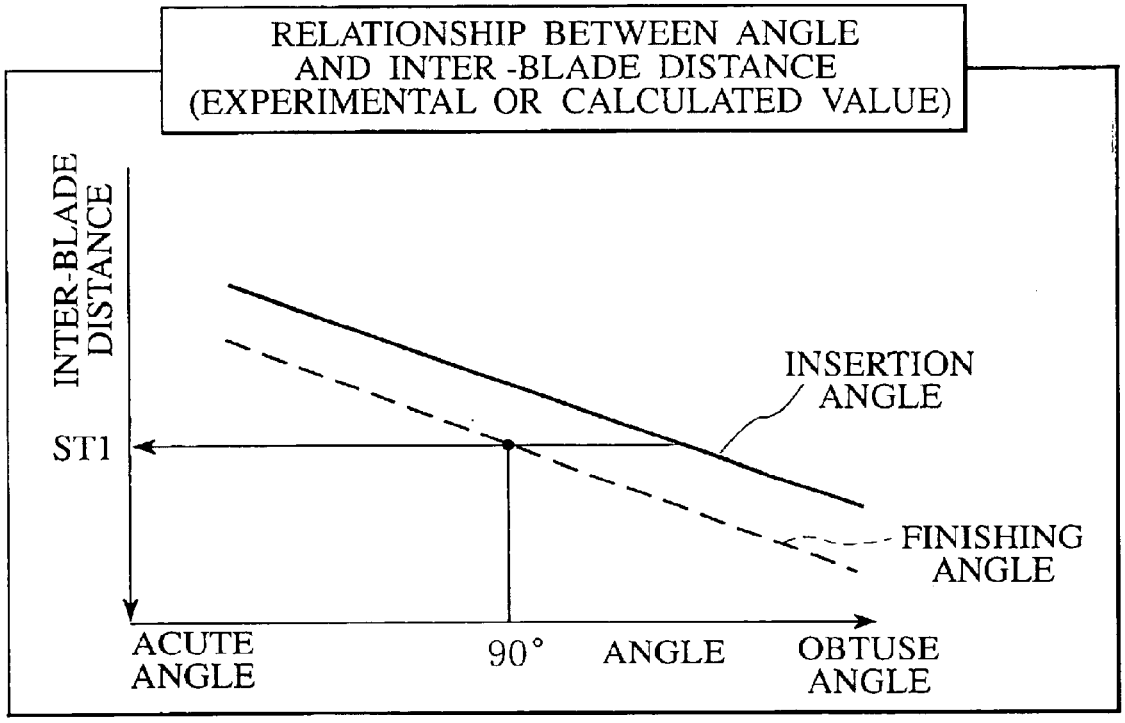
FIG. 18 is a graph showing the relationship between angle and inter-blade distance.

Using a graph showing the relationship between the bending angle and the inter-blade distance stored in the database 43 as shown in FIG. 18 or a calculation expression, an inter-blade distance ST1 at an insertion angle to obtain a desired bending angle (90 degrees in this case) is obtained (in a step S22). In other words, the graph or calculation expression showing the relationship between the bending angle and the inter-blade distance ST1 shows a finishing angle which is an actual bending angle and an insertion angle in consideration of a spring back quantity calculated from material conditions for each material in advance, it is possible to obtain the insertion angle.

Figure 19:
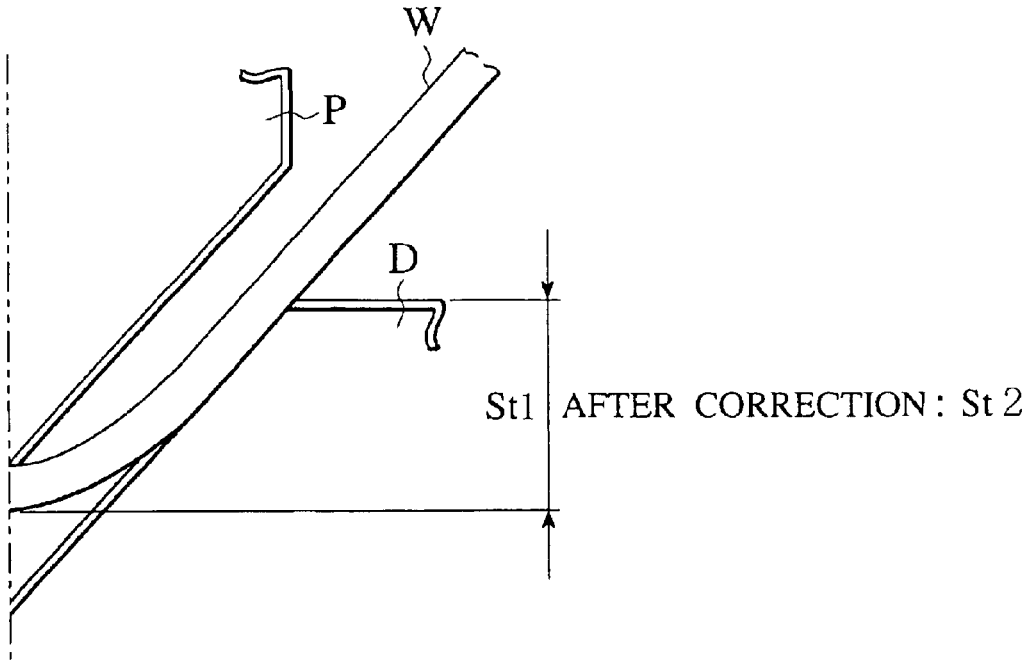
FIG. 19 is a cross-sectional view showing a state of bending.

Thereafter, bending starts (in a step S23). As shown in FIG. 19, while observing the displacement gauge 19, the inter-blade distance is driven to the target blade distance ST1 obtained in the step S22 (in a step S24). If the distance reaches the target inter-blade distance ST1, the workpiece W is unloaded (in a step S25).

The punch P is separated from the die D to take out the workpiece W (in a step S26), and a finishing angle θ' is measured (in a step S27). It is then determined whether or not the finishing angle is within a tolerance (in a step S28). If it is determined that the finishing angle is within a tolerance, the inter-blade distance is recorded as a final inter-blade distance ST for the material conditions and bending conditions at this time (in a step S29) and the bending is ended (in a step SE).

On the other hand, if it is determined that the finishing angle is not within the tolerance, the relationship between the bending angle θ and the inter-blade distance ST1 is corrected to obtain a corrected inter-blade distance ST2 (in a step S30). As this correction method, a method for correcting the distance while assuming that Young's modulus E has no change and a method for correcting the distance while assuming that the n-value has no change may be employed.

Description will now be given while taking a target bending angle of 90 degrees as an example.

Figure 20:
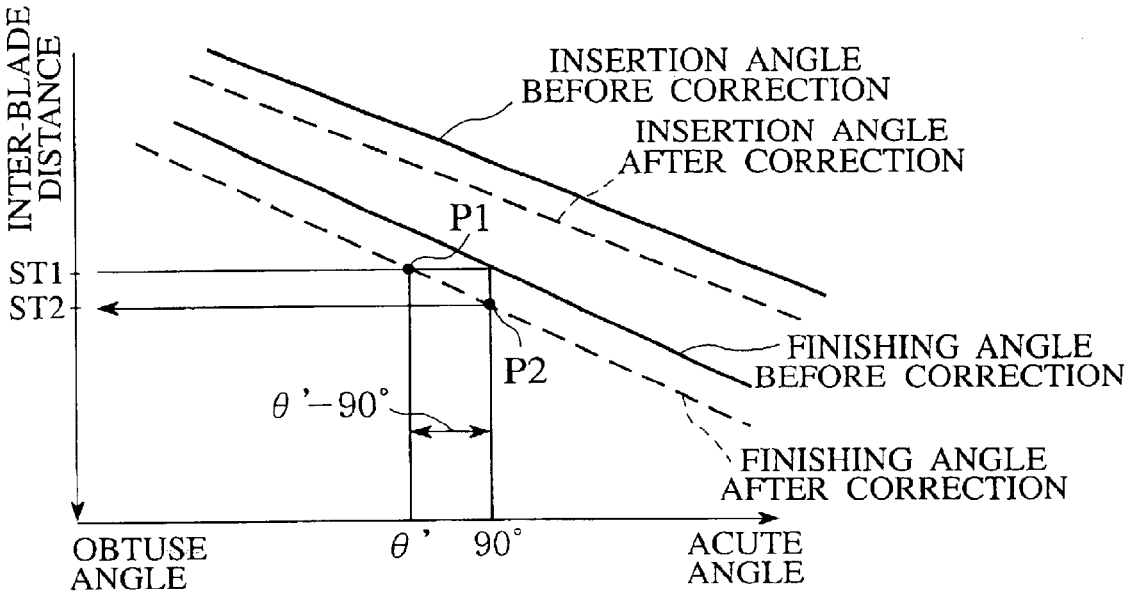
FIG. 20 is a graph showing that the relationship between the angle and the inter-blade distance is corrected if it is assumed that Young's modulus has no change.

First, referring to FIG. 20, in the correction method on the assumption that the Young's modulus E, i.e., spring back has no change, a finishing angle line is corrected so as to pass the intersection P1 between the inter-blade distance ST1 relative to the target bending angle of 90 degrees before correction and the actual finishing angle θ'. Since the angle difference between the insertion angle and the finishing angle has no change between before-correction and after-correction, an insertion angle line and a finishing angle line are displaced by a quantity proportional to the difference θ'−90 between the target bending angle of 90 degrees and the measured finishing angle θ' at the center of one point (indicated by broken lines in FIG. 20, respectively). As a result, the inter-blade distance ST2 after the correction is obtained from the intersection P2 between the target bending angle of 90 degrees and the finishing angle.

As other methods for displacing the insertion angle line and the finishing angle line, there are a method for offsetting a displacement quantity in parallel, a method for re-calculating an inter-blade distance at each angle using the reciprocal of a material constant and the like.

Figure 21:
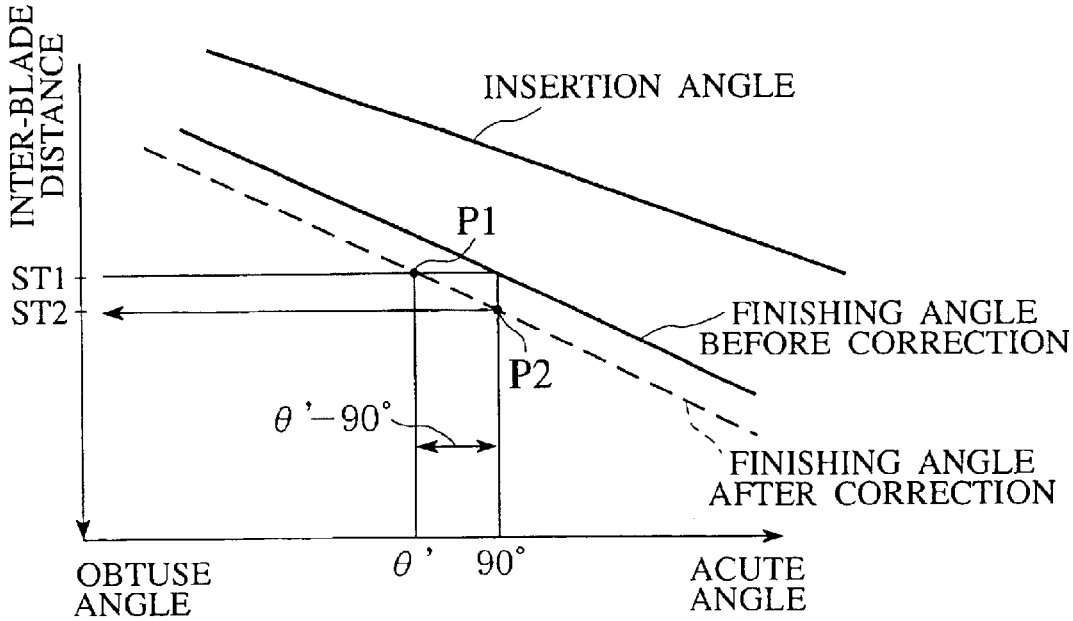
FIG. 21 is a graph showing that the relationship between the angle and the inter-blade distance is corrected if it is assumed that an n-value has no change.

In the correction method on the assumption that the n-value, i.e., a plastic range has no change, the insertion angle does not change. Therefore, as shown in FIG. 21, the finishing angle line is displaced by the difference θ'−90 between the target bending angle of 90 degrees and the measured finishing angle θ' (indicated by a broken line in FIG. 21).

As methods for displacing the finishing angle line, there are a method for offsetting displacement quantities in parallel, a method for re-calculating an inter-blade distance at each angle using the reciprocal of the material constant besides a method for displacing the line at the center of one point, as in the case of the correction method on the assumption that the Young's modulus E has no change.

Next, the workpiece W which has been bent is re-set and a drive-in processing starts (in a step S31), followed by a step S24 to repeat the steps after the step S24. Here, if the finishing angle θ' measured previously is not more than 90 degrees, the workpiece W is already bent excessively. Therefore, a new workpiece W is used to start over bending without using the previously bent workpiece W.

From the above-stated results, the bending angle obtained by the first bending is measured and the graph or calculation expression showing the relationship between the bending angle and the inter-blade distance ST is corrected based on the difference between the measured angle and the target angle, so that it is possible to obtain an accurate inter-blade distance ST for the bending angle. It is thereby possible to bend workpieces W of the same material at accurate angle by once bending.

Next, the third embodiment of the present invention will be described with reference to FIGS. 22 to 25.

Figure 22:
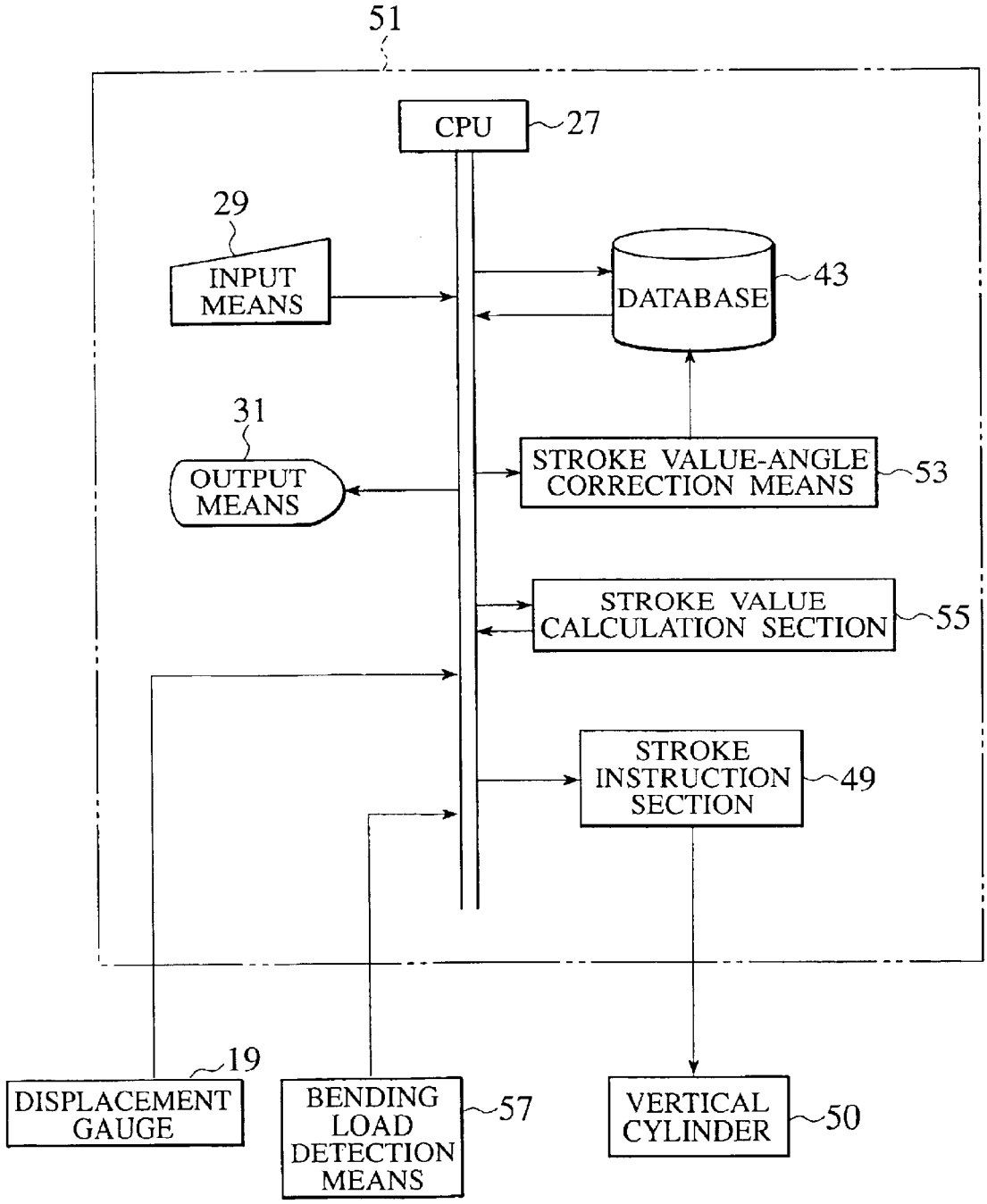
FIG. 22 is a block diagram showing the configuration of a controller according to the third embodiment.

Referring first to FIG. 22, a controller 51 includes a CPU 27 or a central processing unit, to which an input means 29 such as a keyboard for inputting various data and an output means 31 such as a CRT for displaying the various data are connected. Further, a displacement gauge 19 already described above and a bending load detector 57 which is a bending load detection means are connected to the CPU 27 so that a detection signal can be transmitted.

Furthermore, a database 43 storing the various data input from the input means 29, the relationship between stroke value and angle and that between stroke value and load, a stroke value-angle correction means 53 for correcting the stroke value-angle relationship stored in the database 43 based on a measured stroke value and a measure bending load while bending a workpiece using the displacement gauge 19 and the bending load detector 57, a stroke value calculation means 55 for calculating a new target stroke value from the stroke value-angle relationship corrected by this stroke value-angle correction means 53, and a stroke instruction section 49 controlling a vertical cylinder 50 and thereby control the stroke of a punch P, are connected to the CPU 27.

Figure 23:
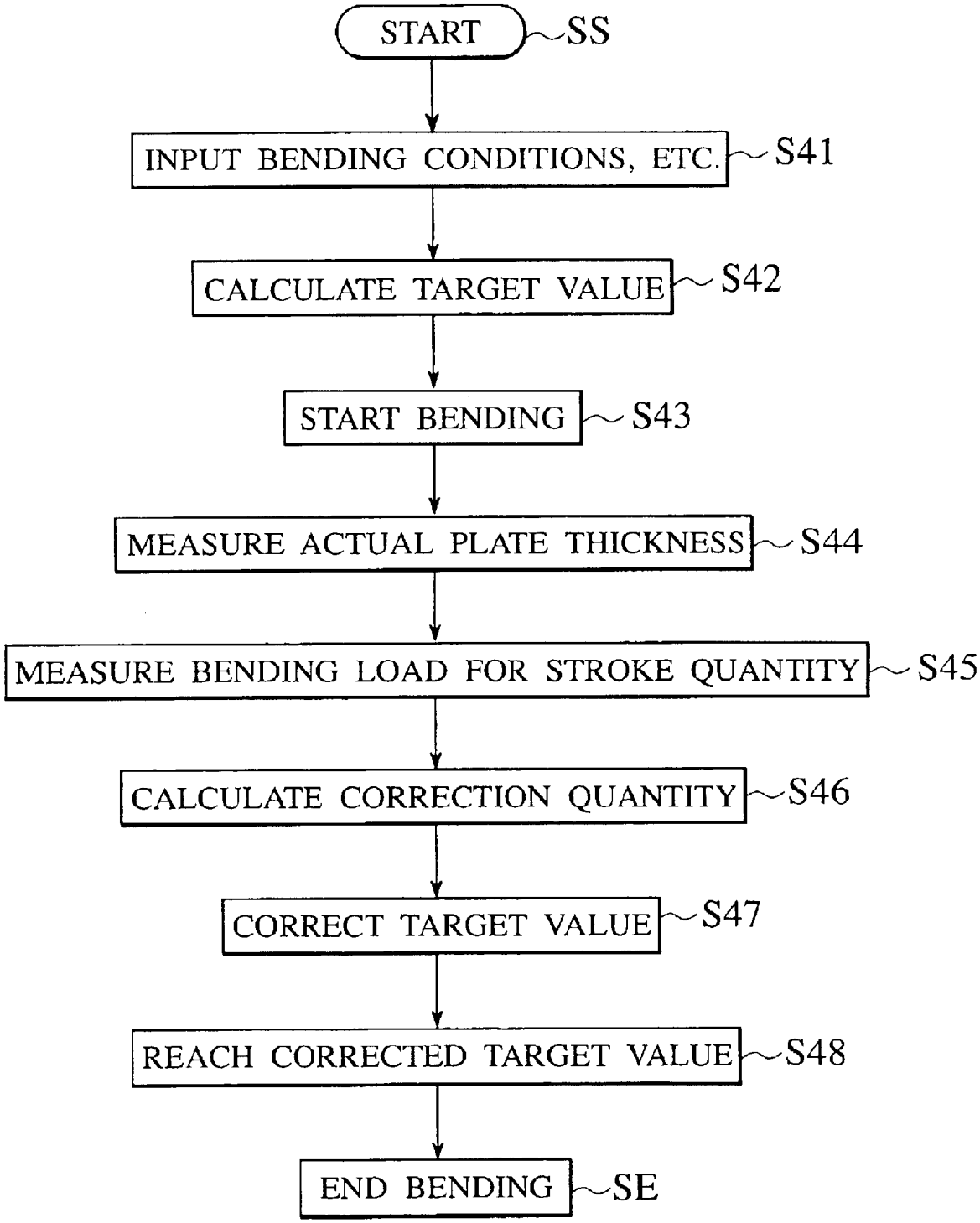
FIG. 23 is a flow chart showing the steps of a bending method according to the third embodiment.
Figure 24:
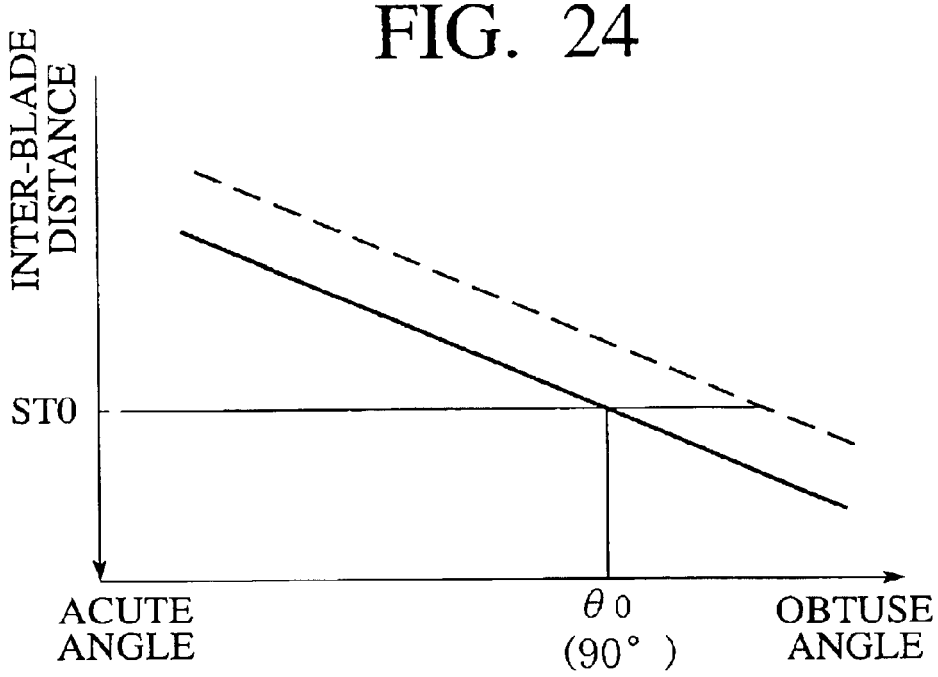
FIG. 24 is a graph showing the relationship between angle and inter-blade distance.

A bending method according to the third embodiment will next be described with reference to FIGS. 23 to 25.

When a processing starts (in a step SS), bending conditions such as a target bending angle θ0, die conditions including a die groove angle DA, a die V width V, a die shoulder are DR and a punch tip end are PR, material conditions including an n-power law hardening exponent, Young's modulus E and a plastic coefficient F and a plate thickness t and the like are input from the input means 29 (in a step S41).

Next, the stroke value calculation means 55 calculates the target stroke value ST0 of the punch P for a target bending angle θ0 from the stroke value-bending angle θ relationship stored in the database 43 (in a step S42). Namely, as shown in FIG. 24, the target stroke value ST0 for the inputted target bending angle θ0 (e.g., 90 degrees) is calculated from the stroke value-bending angle relationship θ obtained by an experiment or the like in advance and stored in the database 43.

Bending starts for the target stroke value ST0 (in a step S43), the actual plate thickness of the workpiece W is measured by an external plate thickness measurement means such as a caliper (in a step S44). Alternatively, the actual plate thickness may be measured before the bending start and input as a bending condition in advance.

Figure 25:
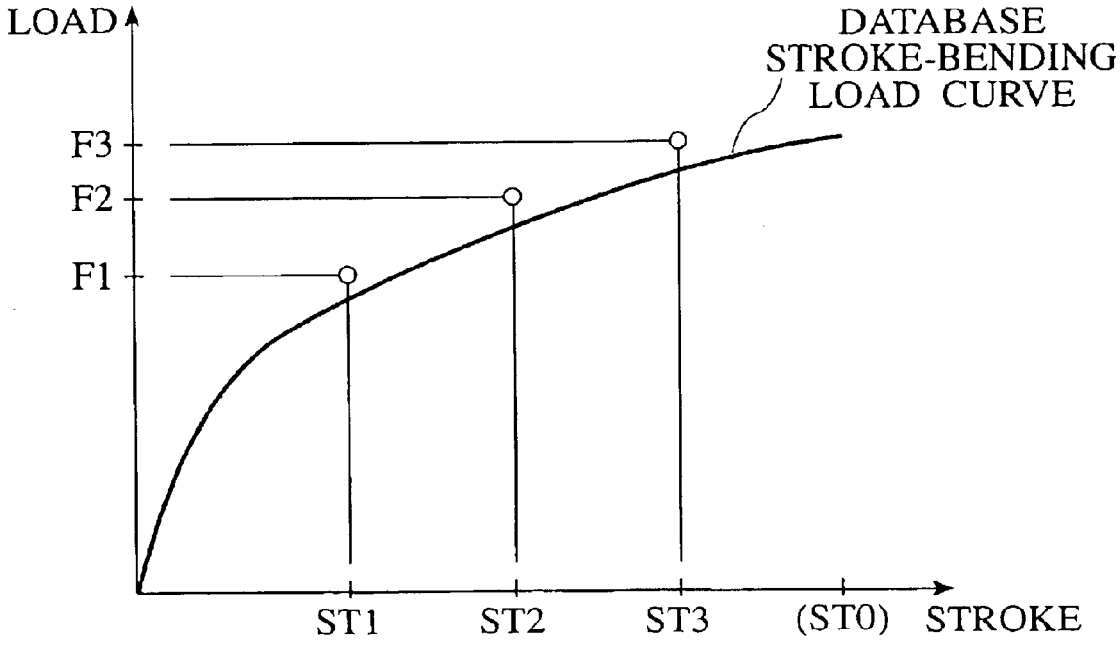
FIG. 25 is a graph showing the relationship between stroke and bending load.

As already shown in FIG. 6, the stroke value ST is measured using the displacement gauge 19 while the punch P is relatively descended, a load F at this time is detected by the bending load detector 27, and bending—bending loads F1, F2 and F3 for a plurality of (e. g., two to four, three or one) arbitrary stroke values ST1, ST2 and ST3 are detected until the stroke value ST reaches a target stroke value ST0 as shown in FIG. 25 (in a step S45).

As the bending load detector 57, a hydraulic sensor may be employed in a hydraulic press brake 1. The bending load can be measured from the torque of a motor in a press brake using a ball spring. Alternatively, the bending load may be detected by attaching a gauge to each frame.

Next, the stroke-angle correction section 53 obtains a stroke value correction quantity a based on the three couples of stroke value and bending load value (ST1, F1), (ST2, F2) and (ST3, F3) obtained in the step S45 (in a step S46). Here, the correction quantity a is a function of the actual plate thickness, bending loads at certain stroke positions (ST1, F1), (ST2, F2) and (ST3, F3), die conditions, a material constant, the target stroke value ST0, the target bending angle θ0 and the like. That is, the correction quantity a is given by a=f(actual plate thickness, bending loads at certain stroke positions (ST1, F1), (ST2, F2) and (ST3, F3), die conditions, material constant, target stroke value ST0, target bending angle θ0).

The stroke-angle correction section 53 corrects the target stroke value ST0 using the correction quantity a as described above, thereby obtaining (corrected target stroke value ST0)=(previous target stroke value ST0)−a (in a step S47).

The stroke instruction section 49 causes the punch P to make a stroke relative to the corrected target value ST0 and if it is determined that the target stroke value reaches the corrected target value ST0 (in a step S48), the bending is ended (in a step SE).

As can be seen from these results, a bending load for a certain stroke value is measured until the stroke value reaches a stroke value for the tentative target angle obtained from the stroke value-angle relationship stored in the database 43, this measured value is compared with the stroke value-load relationship stored in the database 43 in advance to thereby correct the stroke value-angle relationship. It is, therefore, possible to calculate a true stroke value for a target bending angle. It is possible to carry out bending with high accuracy, accordingly.

Finally, the fourth embodiment of the present invention will be described with reference to FIGS. 26 to 31.

Figure 26:
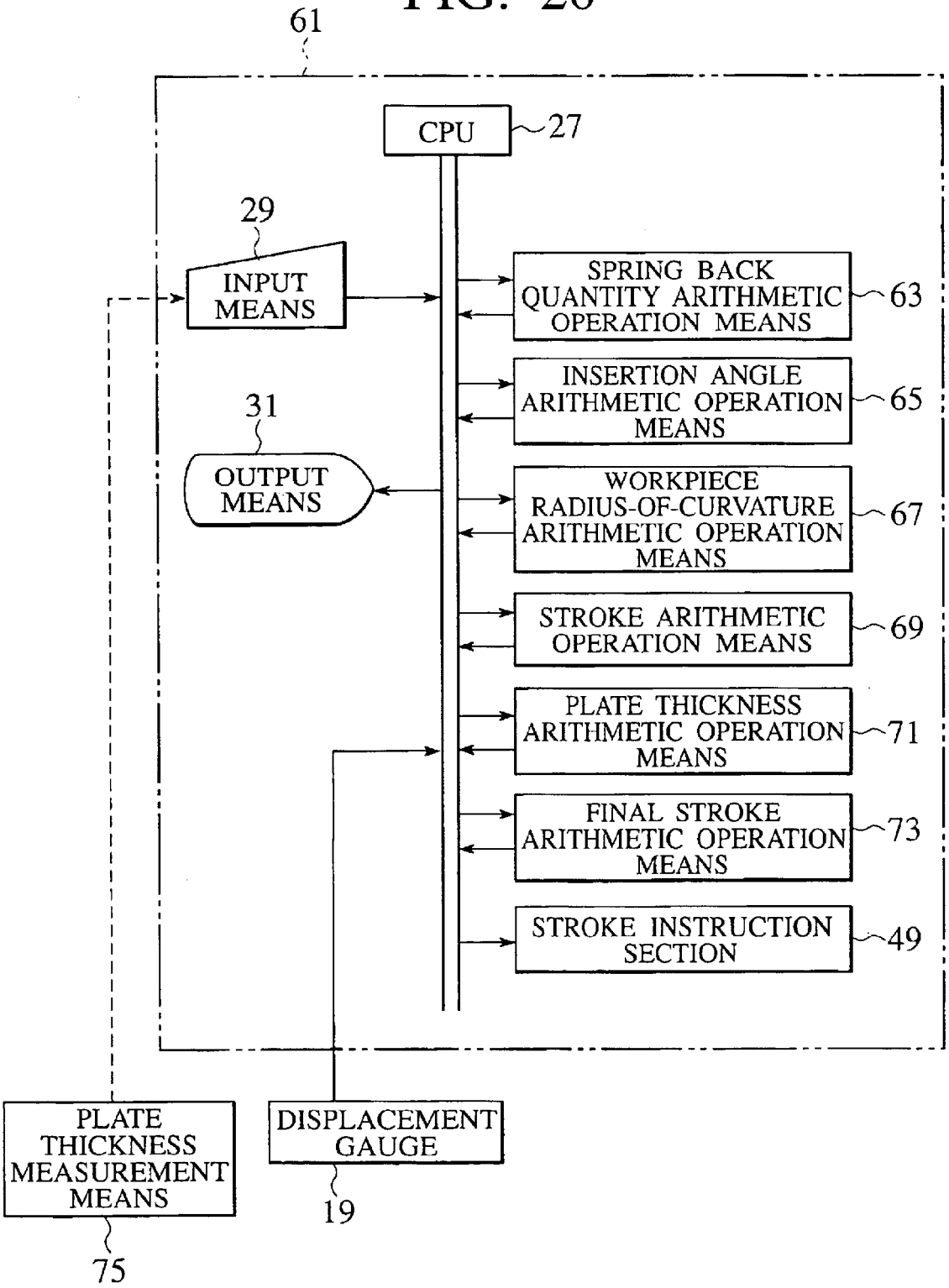
FIG. 26 is a block diagram showing the configuration of a controller according to the fourth embodiment.
Figure 27:
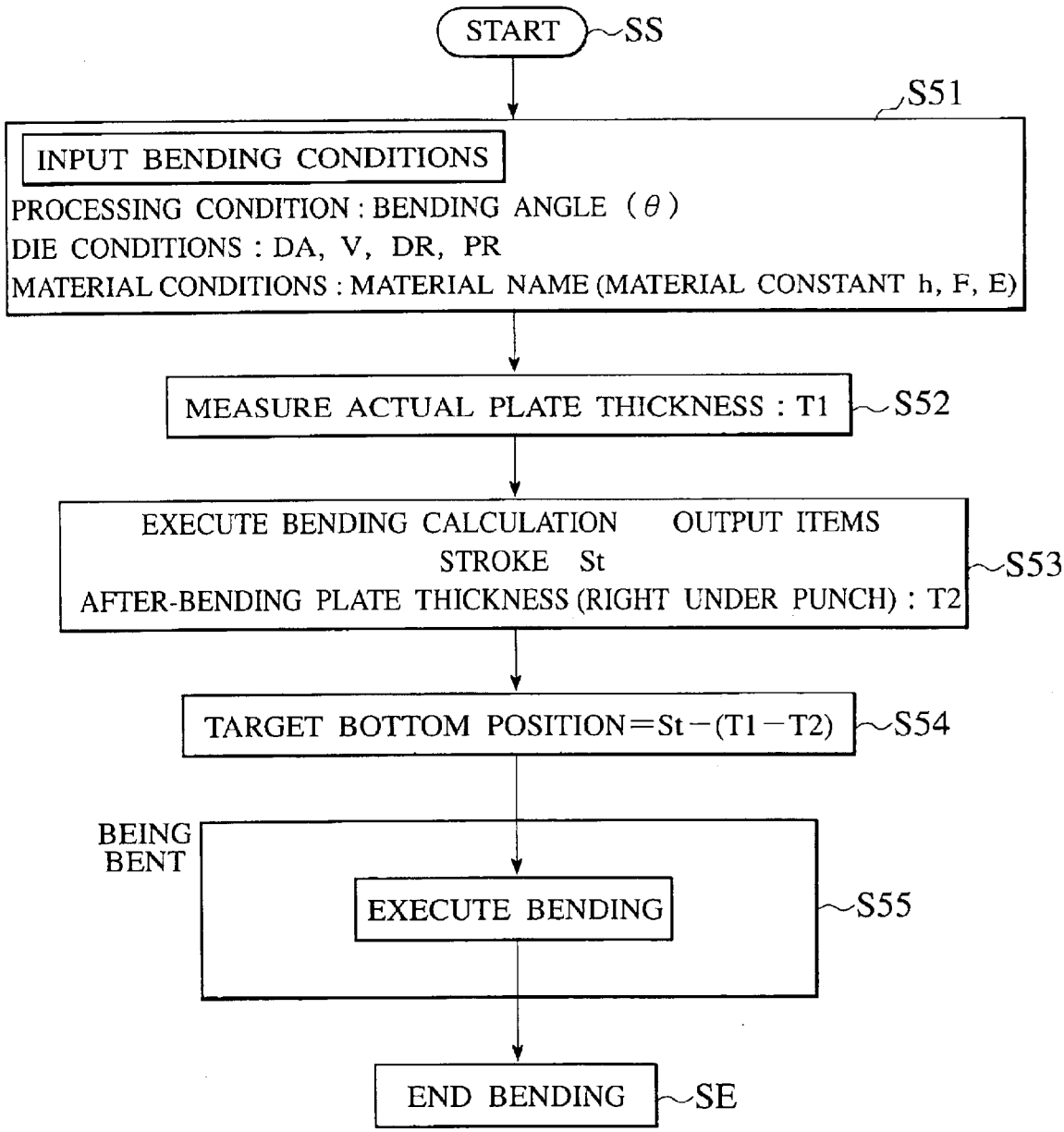
FIG. 27 is a flow chart showing a bending method according to the third embodiment.

First, referring to FIG. 26, a controller 61 includes a CPU 27 or a central processing unit, to which an input means 29 such as a keyboard for inputting various data and an output means 31 such as a CRT for displaying the various data are connected. A displacement gauge 19 is also connected to the CPU 27 so that a detection signal can be transmitted.

Further, a spring back quantity arithmetic operation means 63 for calculating a spring back quantity Δθ based on the inputted bending conditions, an insertion angle arithmetic operation means 65 for calculating an insertion angle θ1 based on the spring back quantity Δθ, a workpiece radius-of-curvature arithmetic operation means 67 for calculating the radius of curvature ρ of a workpiece W right under a punch P based on the insertion angle θ1, a stroke arithmetic operation means 69 for obtaining a target insertion angle θ1 based on a before-bending plate thickness T1 which is a true plate thickness before bending starts, a plate thickness arithmetic operation means 71 for calculating an after-bending plate thickness T2 at bending end time t1 from the calculated radius of curvature ρ of the workpiece W and the before-bending plate thickness T1, a final stroke arithmetic operation means 73 for calculating a final stroke (bottom position) from the before-bending plate thickness T1 and the after-bending plate thickness T2, are connected to the CPU 27. It is noted that a stroke instruction section 49 instructing a vertical cylinder 50 to elevate the punch is also connected to the CPU 27.

A bending method according to the fourth embodiment will next be described with reference to FIGS. 27 to 31.

When a processing starts (in a step SS), bending conditions such as a target bending angle θ, die conditions including a die groove angle DA, a die V width V, a die shoulder are DR and a punch tip end are PR, material conditions including an n-power law hardening exponent, Young's modulus E and a plastic coefficient are input by the input means 29 (in a step S51).

The plate thickness measurement means 75 such as caliper measures the plate thickness of the workpiece W and the before-ending plate thickness T1 (see FIG. 29) which is a true plate thickness is input from the input means 29 (in a step S52) and the plate thickness arithmetic operation means 71 calculates a bending quantity at the before-bending plate thickness T1, thereby obtaining a stroke value ST and the after-bending plate thickness T2 of the workpiece W after bending right under the punch P (in a step S53).

Figure 30:
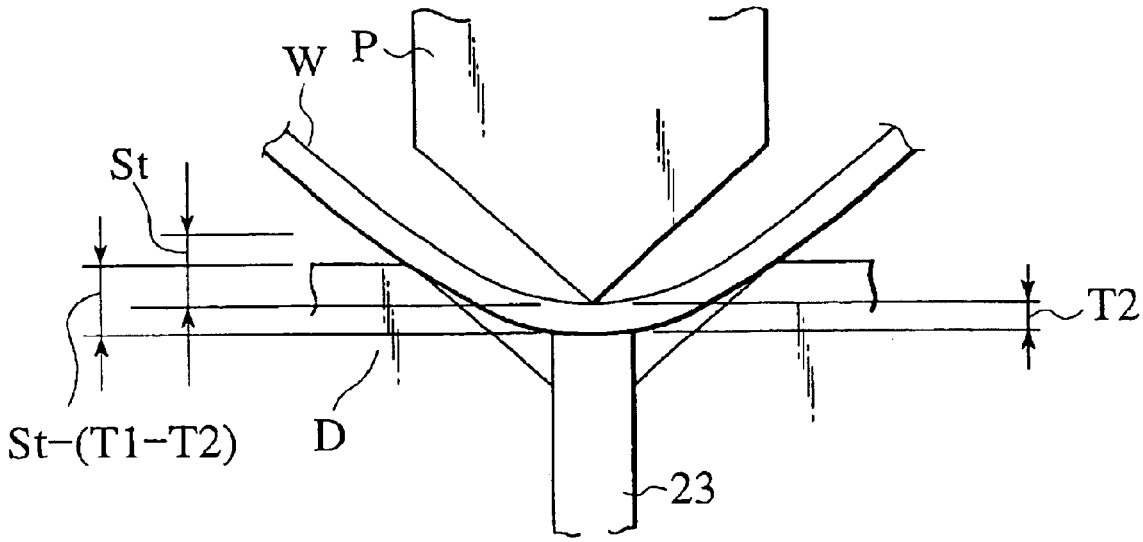
FIG. 30 is an explanatory view showing the plate thickness of the workpiece after bending.

Referring to FIG. 30, the final stroke arithmetic operation means 73 calculates a target bottom position ST0 on the lower surface of the workpiece W from ST=ST−(T1−T2) (in a step S54) and bending is conducted down to the target bottom position ST0 (in a step S55).

Figure 28:
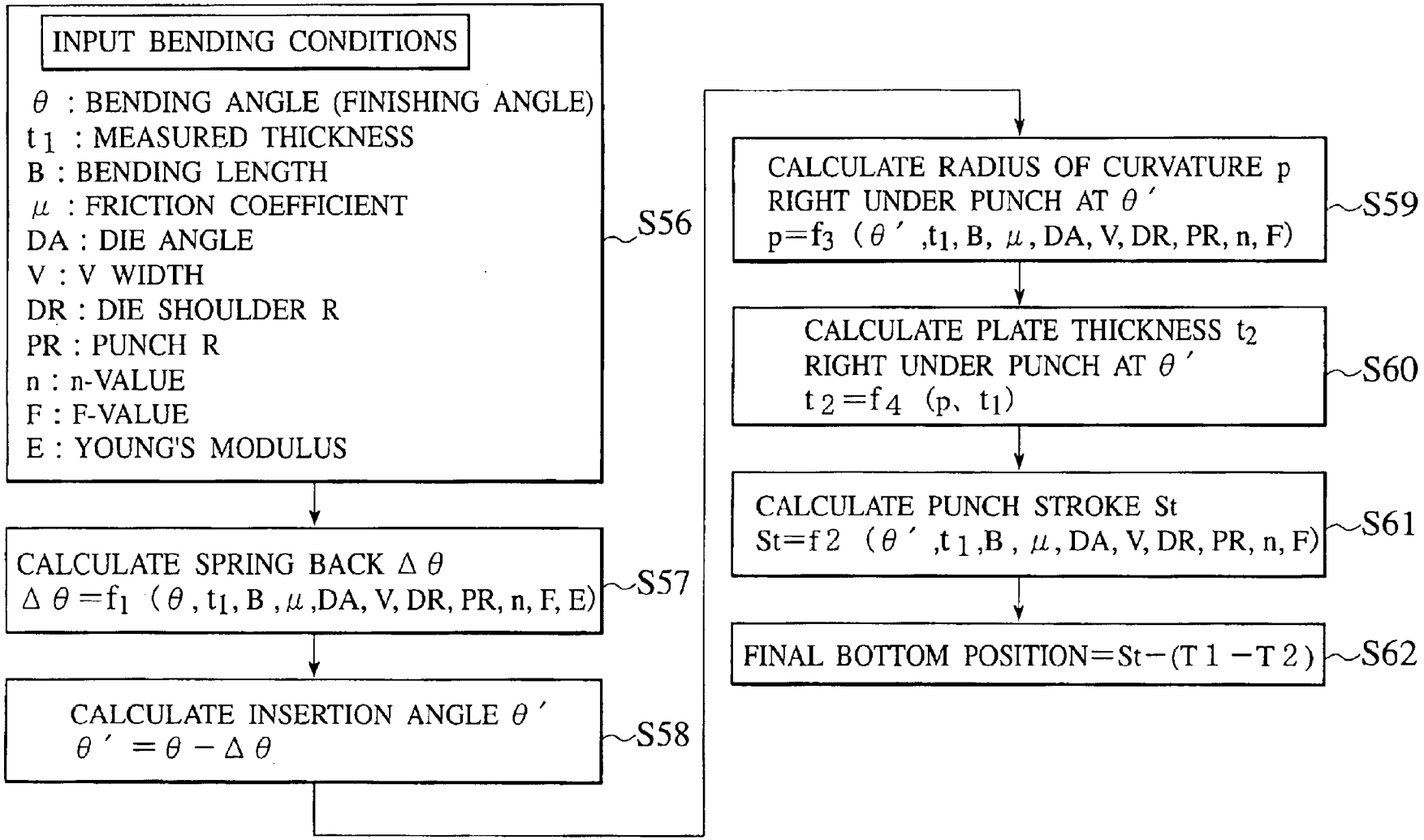
FIG. 28 is a flow chart for reflecting the decrease of the plate thickness of a work by bending on stroke control.
Figure 29:
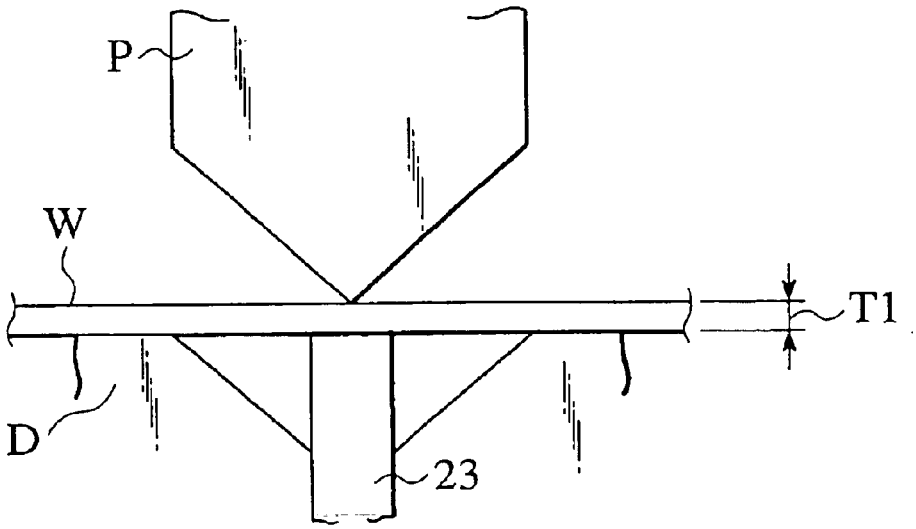
FIG. 29 is an explanatory view showing the plate thickness of the workpiece before bending.

Referring to FIG. 28, in the above-stated bending, the spring back quantity arithmetic operation means 63 calculates the spring back quantity Δθ (in a step S57) from the bending conditions such as the bending angle θ, the actual plate thickness T1 of the workpiece W, a bending length B, a friction coefficient $\mu$, the die groove angle DA, the die V width V, the die shoulder are DR, the punch tip end are PR, the material conditions including the n-power law hardening exponent, the Young's modulus E and the plastic coefficient F input in the steps S51 and S52 (in a step S56). That is, the spring back quantity Δθ is calculated from ?θ=f1 (θ1, T1, B, $\mu$, DA, V, DR, PR, n, E, F).

Next, the insertion angle arithmetic operation section 65 subtracts the spring back quantity ?θ from the target bending angle θ and thereby calculates the insertion angle θ1. That is, the insertion angle θ1 is calculated from θ1=θ−Δθ (in a step S58).

Figure 31:
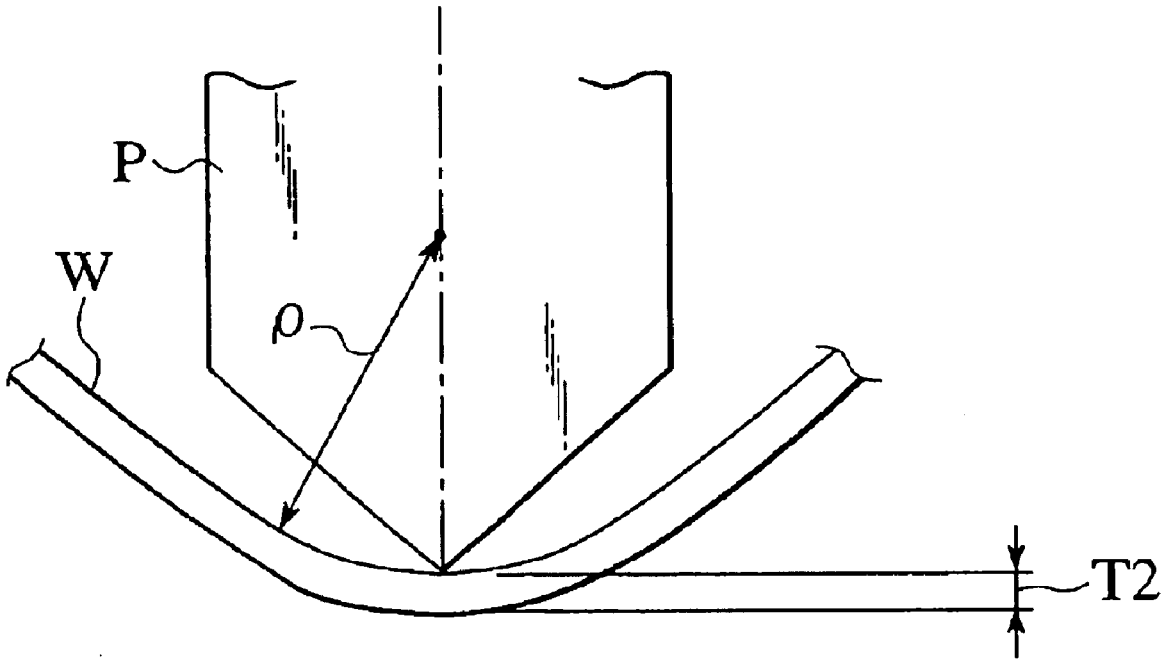
FIG. 31 is an explanatory view showing the relationship between the radius of curvature of the workpiece and the plate thickness thereof after bending.

The workpiece radius-of-curvature arithmetic operation means 67 calculates the radius of curvature ρ of the workpiece W right under the punch P at the time of bending the workpiece W at the calculated insertion angle θ1 from ρ=f3 (θ1, T1, B, $\mu$, DA, V, DR, PR, n, F) (in a step S59). Referring then to FIG. 31, the plate thickness arithmetic operation means 71 calculates the after-bending plate thickness T2 of the workpiece right under the punch P after the workpiece W is bent at the insertion angle θ1 from T2=f4 (ρ, T1) (in a step S60).

The stroke arithmetic operation means 69 calculates a punch stroke St which becomes a tentative target bottom position for the target insertion angle θ1 if the plate thickness of the workpiece W being bent is the before-bending plate thickness T1 from St=f2(θ1, T1, B, $\mu$, DA, V, DR, PR, n, F) (in a step S61).

Since the plate thickness of the workpiece W decreases and the bottom position of the actual workpiece W is displaced during the bending, the tentative target bottom position St previously obtained is shifted upward by as much as a decrease in plate thickness (T1−T2) to thereby correct the bottom position of the punch P (in a step S62). Namely, since the punch stroke STB at a final bottom position is obtained from STB=St−(T1−T2), the stroke instruction section 49 controls the stroke of the punch P using this punch stroke STB to thereby carry out the bending (in a step S63).

Referring back to FIG. 27, the bending is ended (in a step SE).

As can be seen from these results, the final stroke quantity of the punch P is calculated in light of a decrease in the plate thickness of the workpiece W following the bending and the bending is carried out based on this stroke value, so that it is possible to carry out the bending with high accuracy.

The present invention is not limited to the embodiments stated above and can be executed in other modes. That is, in the above-stated embodiments, the press brake 1 in which the punch P is raised and descended to bend the workpiece has been described. The present invention is also applicable to a press brake of a die D elevation type.

INDUSTRIAL APPLICABILITY

According to the present invention, it is possible to accurately detect the actual plate thickness of a workpiece while bending the workpiece. Even if, in particular, the workpiece is thin or warped, the plate thickness of the workpiece can be accurately detected.

Further, according to the present invention, it is possible to accurately calculate the relative stroke value of a punch for a target bending angle and to carry out bending with high accuracy.

What is claimed is:

1. A plate thickness detection method for a bending machine that bends a workpiece mounted on an upper surface of a die, using a punch and the die cooperatively, the method comprising:

relatively moving a punch from a reference inter-blade distance spaced from the die;

providing, in a V-groove of the die, a displacement gauge that detects a displacement quantity, the displacement gauge being urged upward and measuring a distance to a lower surface of a workpiece;

detecting a relative stroke quantity of the punch using a ram position detector, one of when the displacement gauge initially detects a change in the displacement quantity and at a predetermined point after the change in the displacement quantity is detected;

detecting the displacement quantity when the relative stroke quantity is detected; and determining a plate thickness of the workpiece by subtracting the detected relative stroke quantity from the reference inter-blade distance and adding the displacement quantity of the displacement gauge.

2. The plate thickness detection method according to claim 1, wherein the reference inter-blade distance is a distance between the punch and the die at a top dead center before relatively moving the punch.

3. The plate thickness detection method according to claim 1, wherein the reference inter-blade distance is calculated by mounting a workpiece having a known plate thickness on the die before actual bending, relatively moving the punch to detect the stroke quantity using the ram position detector, detecting the displacement quantity of the displacement gauge when the stroke quantity is detected, and determining the reference inter-blade distance by adding the known plate thickness of the workpiece to the relative stroke quantity of the punch and subtracting the displacement quantity of the displacement gauge.

4. A reference inter-blade distance detection method for obtaining a reference inter-blade distance between a punch and a die at an arbitrary reference position, comprising:

mounting a workpiece having a known plate thickness on the die;

providing a displacement gauge, that gauges a distance from an upper surface of the die to a lower surface of the workpiece, in the die;

relatively moving the punch to bend the workpiece cooperatively with the die; and determining the reference inter-blade distance by adding the known plate thickness to a stroke quantity of the punch and subtracting a displacement quantity of the displacement gauge.

5. A plate thickness detector for a bending machine that bends a workpiece mounted on an upper surface of a die, cooperatively using a punch and the die initially separated by a reference inter-blade distance, the detector comprising:

a displacement gauge provided in a V-groove of the die, the displacement gauge being urged upward and measuring a distance from the upper surface of the die to a lower surface of the workpiece;

a ram position detector that detects a relative stroke quantity of the punch; and a plate thickness calculator that calculates a plate thickness of the workpiece by subtracting the detected relative stroke quantity from the reference inter-blade distance and adding a displacement quantity that is measured by the displacement gauge when the relative stroke quantity is detected, the reference inter-blade distance being one of input and stored in a storage, wherein the ram position detector detects the relative stroke quantity of the punch, one of when the displacement gauge initially detects a change in the displacement quantity and at a predetermined point after the change in the displacement quantity is detected.

6. The plate thickness detector for a bending machine according to claim 5, wherein the reference inter-blade distance is a distance between the punch and the die at a top dead center before relative movement of the punch.

7. The plate thickness detector for a bending machine according to claim 5, further comprising:

a reference inter-blade distance calculator that calculates a reference inter-blade distance after a workpiece, having a known plate thickness, is mounted on the die before actual bending, and after the punch is relatively moved to detect the relative stroke quantity using the ram position detector and to detect the displacement quantity of the displacement gauge, the reference inter-blade distance calculator calculating the reference inter-blade distance by adding the known plate thickness of the workpiece to the relative stroke quantity of the punch and subtracting the displacement quantity of the displacement gauge.

8. A reference inter-blade distance detector for obtaining a reference inter-blade distance between a punch and a die at an arbitrary reference position, comprising:

a displacement gauge provided in a V-groove of the die, the displacement gauge being urged upward and measuring a distance to a lower surface of a workpiece;

a ram position detector that detects a relative stroke quantity of the punch; and a reference inter-blade distance calculator that calculates the reference inter-blade distance, after a workpiece having a known plate thickness is mounted on the die and the punch is relatively moved to bend the workpiece in cooperation with the die, the reference inter-blade distance being calculated by adding the known plate thickness to a stroke quantity of the punch and subtracting a displacement quantity of the displacement gauge.

* * * * *